US009533519B2

(12) United States Patent
Roctus et al.

(10) Patent No.: US 9,533,519 B2
(45) Date of Patent: Jan. 3, 2017

(54) LABEL PRINTER WITH LOCKING ELEMENT COOPERATING WITH CONDUCTIVE BAR OF TAPE CASSETTE

(71) Applicant: DYMO, Sint-Niklaas (BE)

(72) Inventors: Jerry Roctus, Clinge (NL); Geert Van Aerde, Lokeren (BE); Kris Vandermeulen, Bornem (BE); Herman De Rycke, Temse (BE); Marc Francois, Landegem (BE)

(73) Assignee: SANFORD, L.P., Downers Grove, IL (US)

( * ) Notice: Subject to any disclaimer, the term of this patent is extended or adjusted under 35 U.S.C. 154(b) by 0 days.

(21) Appl. No.: 14/213,772

(22) Filed: Mar. 14, 2014

(65) Prior Publication Data

US 2014/0270885 A1 Sep. 18, 2014

(30) Foreign Application Priority Data

Mar. 15, 2013 (GB) ..... 1304743.6

(51) Int. Cl.
*B41J 3/407* (2006.01)
*B41J 15/04* (2006.01)

(52) U.S. Cl.
CPC ..... *B41J 15/044* (2013.01); *B41J 3/4075* (2013.01); *Y10T 29/49826* (2015.01); *Y10T 29/49876* (2015.01)

(58) Field of Classification Search
CPC ..... B41J 15/044; B41J 3/4075
See application file for complete search history.

(56) References Cited

U.S. PATENT DOCUMENTS

| | | | | |
|---|---|---|---|---|
| 5,253,334 | A | 10/1993 | Kimura et al. | |
| 5,930,120 | A * | 7/1999 | Gunther | H05K 9/0016 174/369 |
| 6,017,239 | A * | 1/2000 | Watanabe | H01R 9/226 439/402 |
| 8,834,047 | B2 * | 9/2014 | Van Coppenolle | B41J 15/044 400/208 |
| 2003/0081978 | A1 | 5/2003 | Carriere et al. | |
| 2003/0180675 | A1 * | 9/2003 | Soeda | 431/124 |
| 2011/0103871 | A1 | 5/2011 | Van Coppenolle et al. | |
| 2013/0063161 | A1 * | 3/2013 | Chamarti et al. | 324/654 |

FOREIGN PATENT DOCUMENTS

| | | | | |
|---|---|---|---|---|
| JP | 01047579 | A * | 2/1989 | B41J 35/00 |
| JP | H0272991 | A | 3/1990 | |
| JP | 2000235802 | A * | 8/2000 | |

OTHER PUBLICATIONS

International Search Report and a Written Opinion for International PCT Application No. PCT/EP2014/055199, dated Jun. 26, 2014.

* cited by examiner

*Primary Examiner* — Daniel J Colilla
(74) *Attorney, Agent, or Firm* — Marshall, Gerstein & Borun LLP

(57) ABSTRACT

A cassette comprising at least one portion for engaging with a cooperating locking element of a tape printer when said cassette is correctly located in said printer, said portion comprising an elongate conductive bar extending along said cassette in a direction perpendicular to a rotational axis of a supply roll housed in said cassette.

14 Claims, 35 Drawing Sheets

LABEL PRINTER WITH LOCKING ELEMENT COOPERATING WITH CONDUCTIVE BAR OF TAPE CASSETTE

CROSS-REFERENCE TO RELATED APPLICATION

This application claims priority to United Kingdom patent application GB 1304743.6, filed Mar. 15, 2013. The priority application, GB 1304743.6, is hereby incorporated by reference.

FIELD OF THE DISCLOSURE

The present disclosure relates to a label printer, and particularly to a label printer with cassette detection means and to a cassette for use in a label printer.

BACKGROUND

Label printers are known, which use a supply of tape, housed in a cassette, received in the label printer. The tape comprises an image receiving layer and a backing layer which are secured to one another via an adhesive layer. Such label printers include a cutting mechanism for cutting off a portion of the tape after an image has been printed onto the image-receiving layer so that the portion of tape having the image can be used as a label. After the tape has been cut, the cut portion of the tape is pulled from the printer through a slit in the printer housing. The backing layer can then be removed allowing the image-receiving layer to be secured to an object using the adhesive layer.

Known label printers comprise a cassette-receiving bay in which a cassette is received for printing. A printhead is provided in the cassette-receiving bay for co-operating with the supply of tape to print thereon. A platen may also be provided in the cassette-receiving bay positioned at a side of the tape opposite to the printhead when the cassette is received in the cassette-receiving bay. During printing, the printhead co-operates with the platen, with the tape passing therebetween for printing thereon. The platen may be driven by a motor for propagating the tape during printing. Alternatively, the platen may be freely rotatable and an additional drive roller may be provided for driving the tape during printing.

In an alternative arrangement to that described above, a platen may be provided within the cassette. In such an arrangement, the tape cooperates with a surface of the platen. When received in the cassette-receiving bay the platen in the cassette co-operates with a drive mechanism in the cassette-receiving bay for driving the tape during printing. Alternatively, the platen is freely rotatable and an additional drive roller may be provided for driving the tape. During printing, the printhead in the cassette-receiving bay co-operates with the platen in the cassette with tape passing therebetween for printing thereon.

In one arrangement, the printhead is moveable between a non-printing position and a printing position. In an alternative arrangement, the platen is moveable between a non-printing position and a printing position. In yet another arrangement, both the platen and printhead are movable so as to have non-printing and printing positions.

The tape may be of a direct thermal type on which printing is achieved by direct application of heat from printing elements on the printhead. Alternatively, an ink ribbon may be provided, whereby ink is transferred from the ribbon to an image receiving tape by application of heat to the ink ribbon via printing elements on the printhead. The cassette may include a roll of die cut labels rather than a continuous tape.

A problem exists in all the above-described arrangements, in that for good quality printing the tape and/or ink ribbon must be correctly aligned with the printhead during printing. Furthermore, the tape must remain correctly aligned with the printhead while printing occurs and must smoothly pass the printhead so as to ensure good quality printing. In order to ensure that this is the case, it is advantageous to prevent the cassette from moving during printing and cutting. Furthermore, the position of the cassette within the cassette-receiving bay should be predefined and readily reproducible whenever a cassette is inserted in the cassette-receiving bay.

The problem is exacerbated in hand held printers which may be moved around during printing. In such an apparatus, it is even more important that the cassette is locked in a fixed position during printing.

WO 2006/013466 (DYMO) discloses a cassette locking and ejecting arrangement for a label printer apparatus. A label printer comprising a cassette-receiving bay in which a tape cassette is inserted, is provided. The cassette receiving bay is provided with a plurality of spring-loaded ejecting members for ejecting a cassette from the cassette-receiving bay. When a cassette is inserted in the cassette receiving bay, a pair of locking members hold the cassette in place against the biasing force exerted by the ejecting members. To eject the cassette, the locking members are disengaged from the cassette allowing the cassette to be pushed out of the cassette-receiving bay by the force exerted by the ejecting members.

There is a problem with the above-described arrangement, that when a cassette is inserted into the cassette receiving bay by a user, it is possible that the cassette will not properly engage with all of the locking members. This may occur, for example, if a user presses on only one edge of the cassette during insertion. If a cassette is engaged with one, but not all, of the locking members, then although the cassette may be retained within the cassette receiving bay against the biasing force of the ejecting members, the cassette may not be aligned properly with respect to the platen and print head for printing.

WO 2006/013466 (DYMO) has a pair of locking members which are biased, by means of a spring, towards a locking position so as to lock a cassette inserted into the cassette receiving bay in place. However, in the event that the label printer apparatus is subjected to a sudden impact, i.e. if it is dropped by a user, it is possible that the locking members will be moved against the biasing force of the spring so as to release the cassette. Accordingly, when a user subsequently resumes printing with the label printer apparatus, the cassette will not be properly locked in the cassette receiving bay in the correct position for printing, and printing will be adversely effected or impossible.

Furthermore, in the case that a cassette inserted into a cassette receiving bay is not properly engaged by one or more of a plurality of locking members, it may not be apparent to a user, which locking members are not engaged properly with the cassette and what action is required in order to rectify the problem.

SUMMARY OF THE DISCLOSURE

In a first aspect there is provided a cassette comprising at least one portion for engaging with a cooperating locking element of a tape printer when said cassette is correctly located in said printer, said portion comprising an elongate conductive bar extending along said cassette in a direction perpendicular to a rotational axis of a supply roll housed in said cassette.

Preferably at least a portion of said elongate conductive bar projects from a surface of said cassette.

Preferably said conductive bar is received in at least one support at at least one region along its length.

Preferably said conductive bar is supported approximately mid-way along its length by said at least one support.

Preferably said at least one support comprises first and second receiving portions for supporting opposite ends of said conductive bar.

Preferably said conductive bar is a friction fit in said support.

Preferably said friction fit comprises one of a push-fit and a snap fit.

Preferably said support comprises a U-shape.

Preferably a section of said conductive bar, between said first and second receiving portions, is spaced from a surface of said cassette.

Preferably the cassette further comprises a rib positioned proximate to said conductive bar.

Preferably said rib has a longitudinal axis which extends in a direction parallel to a longitudinal axis of the conductive bar.

Preferably said conductive bar is a friction fit between said at least one support and said rib.

Preferably said cassette comprises a ledge portion projecting from a side of said cassette, said ledge portion comprising said conductive bar.

Preferably said cassette comprises a recess in said side, wherein said ledge portion is located in said recess.

Preferably said cassette comprises a second conductive bar.

Preferably said second conductive bar is located on a side of said cassette opposite from said conductive bar.

Preferably said cassette comprises a base, a top, and at least one side extending between said base and said top, wherein said conductive bar is comprised on said at least one side.

Preferably said bar comprises a metal.

Preferably said bar is cylindrical in cross section.

Preferably a main body portion of said cassette comprises a plastic material.

Preferably said supply roll comprises one of a supply of image receiving tape and a supply of ink ribbon.

In another aspect there is provided a label printing apparatus comprising: a cassette receiving bay adapted to receive a cassette, said cassette receiving bay having a base, an opening opposite the base, and side walls extending between the base and the opening; a cassette locking mechanism comprising at least one locking element having a locking position for engagement with a cassette inserted into said cassette receiving bay; and cassette detection means operable to determine whether said at least one locking element is engaged with a cassette inserted into the cassette receiving bay; wherein the cassette detection means comprises at least one conductive surface disposed on the at least one locking element; wherein the locking element comprises a first ramped surface for engaging a surface of a cassette as the cassette is inserted into the cassette receiving bay so as to cause deflection of said locking element, and a second ramped surface positioned below said first ramped surface and arranged to contact a conductive portion of the cassette for retaining the cassette when it is correctly inserted in the cassette receiving bay.

Preferably said first and second ramped surfaces converge towards a connecting portion connecting said first and second ramped surfaces.

Preferably said locking element comprises at least one shoulder portion adjacent said first ramped portion.

Preferably said conductive surface extends over said second ramped surface, said shoulder portion and over a rear side of said locking element towards a terminal of said conductive surface.

Preferably said conductive surface comprises a concavely curved portion adjacent said second ramped surface.

In another aspect there is provided a method of manufacturing a cassette for a label printing apparatus, said method comprising: providing a cassette main body having a base, a top, and sides extending between said base and said top; and inserting a conductive bar into a receiving portion of said cassette, such that said conductive bar extends along said cassette in a direction perpendicular to a rotational axis of a supply roll housed in said cassette.

Preferably said conductive bar is manually inserted into said receiving portion.

Preferably said conductive bar is inserted into said receiving portion as part of an automated process.

Preferably said conductive bar is a friction fit in said receiving portion.

Preferably said friction fit comprises one of a push-fit and a snap-fit.

BRIEF DESCRIPTION OF THE DRAWINGS

For a better understanding of the present disclosure and to show how the same may be carried into effect, embodiments of the present disclosure will now be described by way of example only with reference to the accompanying drawings, in which:

FIG. 27 is a view of a locking element of a label printer according to an embodiment;

FIG. 28 is a view of a locking element of a label printer according to an embodiment;

FIG. 29 is a view of a locking element of a label printer according to an embodiment;

DETAILED DESCRIPTION OF THE PREFERRED EMBODIMENTS

Figure 1:
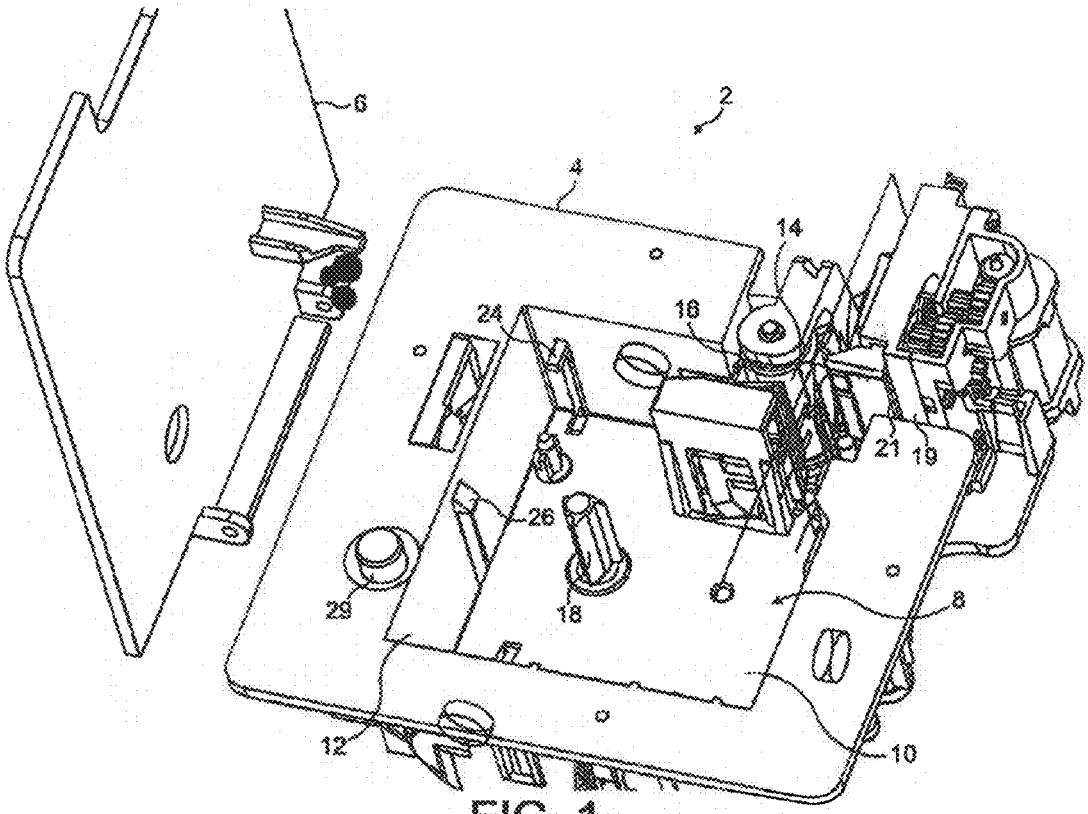
FIG. 1 is a top perspective view of an embodiment of a label printer according to the present invention, the label printer having its lid open and no cassette present.

Referring to FIG. 1, the label printer 2 comprises a body 4, a lid (or cover) 6 and a cassette-receiving bay 8. The cassette-receiving bay 8 has an opening in a top portion of the body for vertical insertion of a cassette. Alternatively the opening could be on another side of the label printer 2. The lid 6 is hinged for closing over the top opening. In an alternative embodiment, the lid (or cover), may be a detachable lid which is completely detachable from the body 4 of the label printer 2 when in an open position.

The cassette-receiving bay 8 comprises a recess forming an opening for receiving a cassette. The recess is formed by a base 10 and sides 12 extending from the base 10 to the top opening. A platen 14 and a printhead 16 are provided in the cassette-receiving bay 8. The printhead 16 is movable towards the platen 14 whereby, during printing, the printhead 16 co-operates with the platen 14, with tape passing therebetween for printing thereon. The platen 16 is driven by a motor (not shown) for propagating the tape during printing. An ink ribbon take-up sprocket 18 extends from the base 10 of the cassette-receiving bay 8 for cooperating with an ink ribbon take-up spool of a cassette when inserted into the cassette-receiving bay 8. The sprocket 18 is driven by a motor (not shown) for winding the ink ribbon around the ink ribbon take-up spool during printing. A slit 19 is provided in the body 4 of the label printer forming an exit through which the tape passes after printing. A cutting mechanism 21 is provided adjacent the exit slit 19 for cutting off the printed portion of tape to provide a printed label.

A first ejector element 24 is visible on a side-wall of the cassette-receiving bay 8. Also visible in FIG. 1 is a locking element 26 of a locking mechanism (which is not visible) on the left hand side of the cassette-receiving bay 8. The locking element 26 is described in more detail below. An actuator button 29 is provided on the surface of the body 4 for actuating the locking mechanism.

Figure 2:
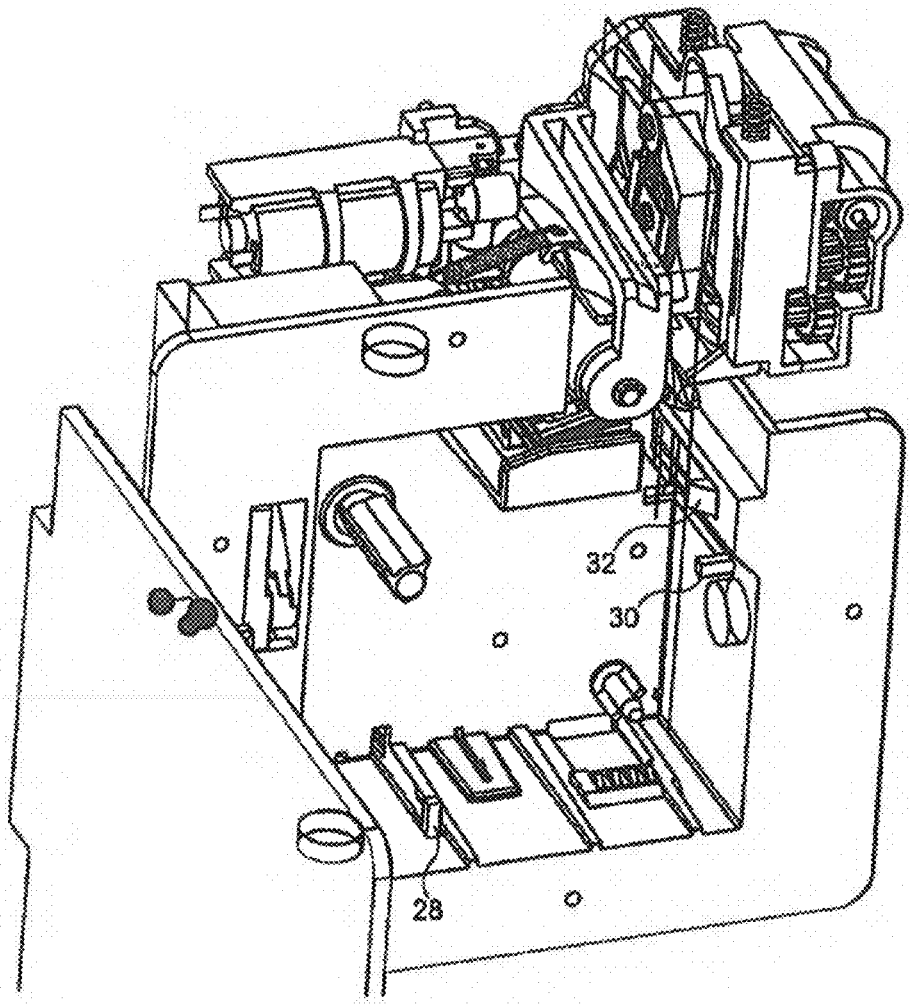
FIG. 2 is another top perspective view of the label printer shown in FIG. 1.
Figure 3:
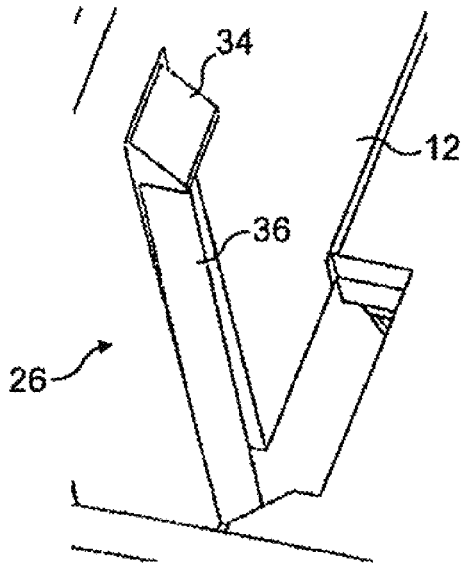
FIG. 3 is a view illustrating the position of a first locking element of the label printer shown in FIG. 1.
Figure 4:
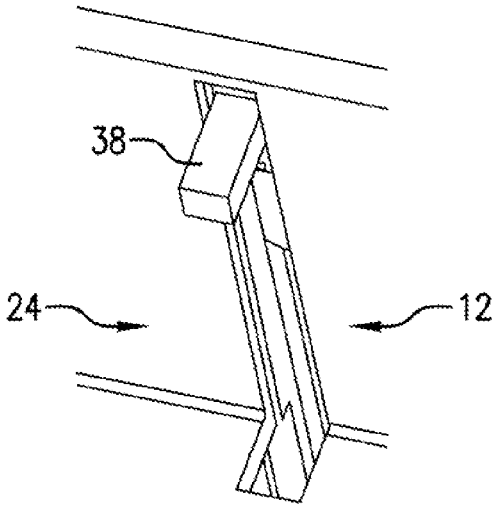
FIG. 4 is a view illustrating the position of a first ejector element of the label printer shown in FIG. 1
Figure 5:
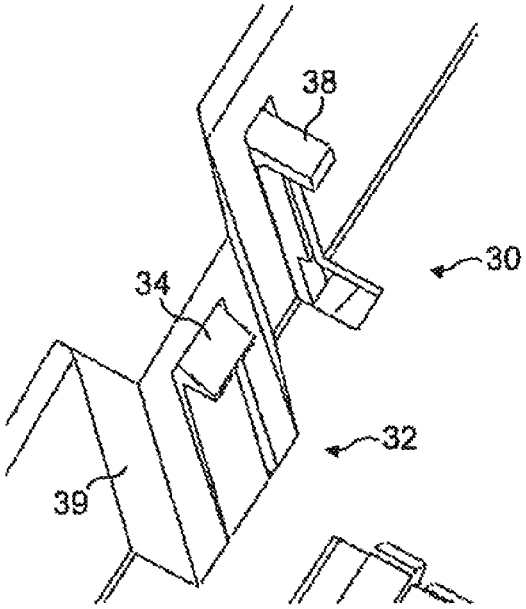
FIG. 5 is a view illustrating the position of a second locking element of the label printer of FIG. 2.
Figure 6:
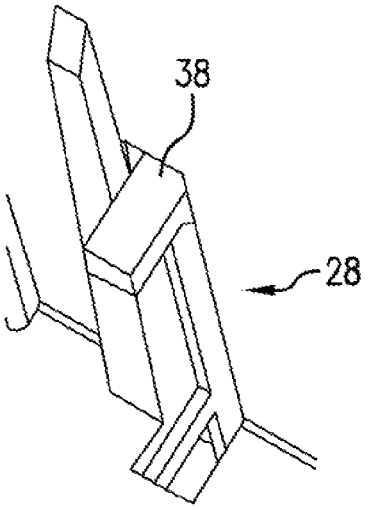
FIG. 6 is a view illustrating the position of a second ejector element of the label printer shown in FIG. 2.

Referring to FIG. 2, a second ejector element 28 of a second ejector mechanism (which is not visible) is shown on the opposite side wall of the cassette receiving bay 8 to the first ejector element 24. A third ejector element 30 of a third ejector mechanism (which is not visible) is positioned on the right hand side of the cassette receiving bay 8. A second locking element 32 of the locking mechanism (which is not visible) is positioned on the right hand side of the cassette-receiving bay 8.

Referring to FIGS. 3, 4, 5 and 6, each of the locking and ejector elements 24, 26, 28, 30, 32 are provided at the sides of the cassette-receiving bay 8 and extend into the cassette-receiving bay 8 through openings in the sides for interaction with an inserted cassette.

Each locking element 26, 32 comprises a projection 34 and an elongate element 36 extending in a direction from the base 10 towards the top opening of the cassette-receiving bay 8. The projection 34 is at a top end of the elongate element 36 and extends towards a central portion of the cassette-receiving bay 8 through a corresponding opening in the side wall 12 of the cassette-receiving bay 8. Each projection 34 has a sloped upper surface for cooperating with a cassette inserted into the cassette-receiving bay 8 for moving the locking element from a locking position to an unlocked position. One of the side walls of the cassette-receiving bay 8 has a portion 39 projecting into the cassette-receiving bay 8 forming a guide for a corresponding recess in a cassette when inserted into the cassette-receiving bay 8. The locking element 32 is positioned in an opening in the guide 39 and extends therefrom into the cassette-receiving bay 8 thereby forming a combined guiding and locking arrangement. The locking elements 26 and 32 shown in FIGS. 1, 2, 3 and 5 show one example of the structure of a locking element, and it should be appreciated that the locking element can take the form of other configurations (see for example FIGS. 27 to 29).

Each ejecting element 24, 28, 30 extends from the side wall of the cassette-receiving bay 8 part way into the cassette-receiving bay 8 and has a free end unconnected to any other structural elements. The ejector elements 24, 28, 30 comprise an elongate element 38 extending in a perpendicular direction relative to the side wall through an opening in the side wall.

Figure 7:
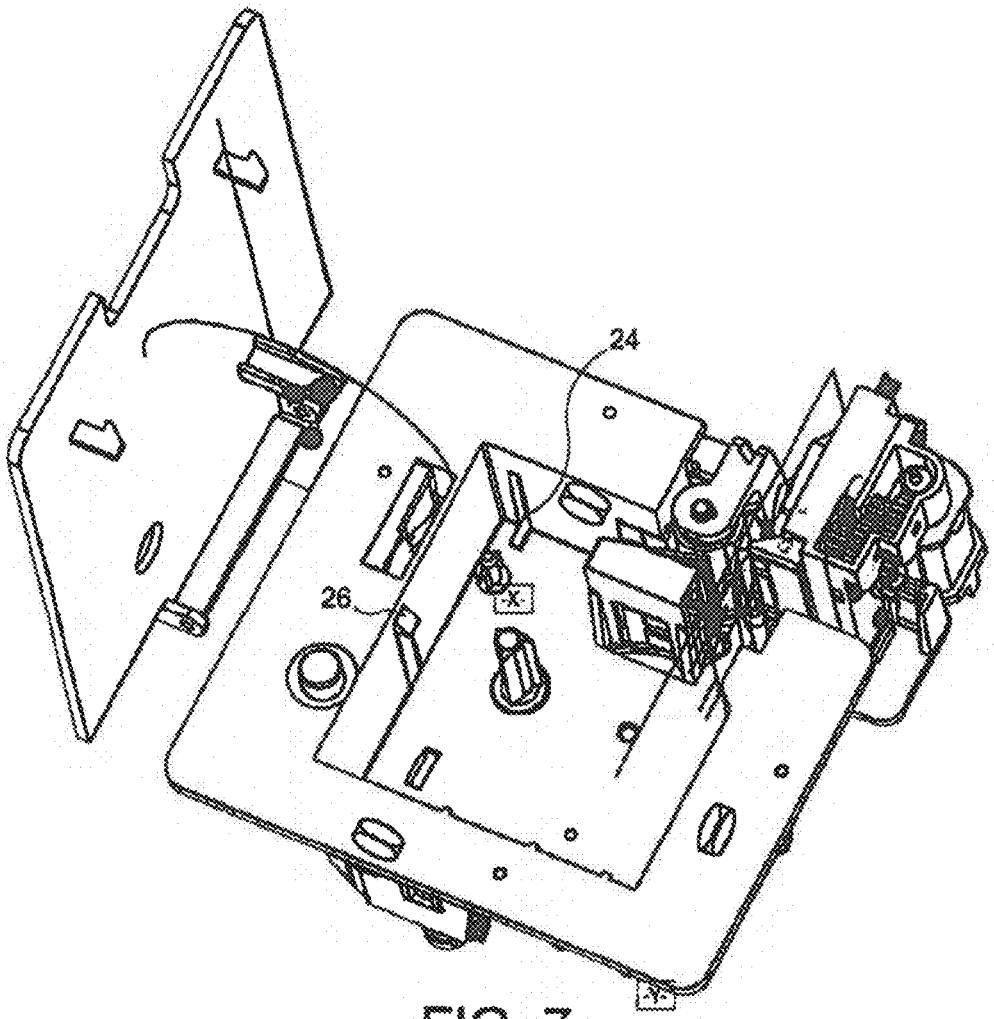
FIG. 7 is a top perspective view of the label printer of FIG. 1 illustrating the positions of a first locking element and a first ejector element with a cassette installed in the cassette-receiving bay (the cassette is not shown for clarity)
Figure 8:
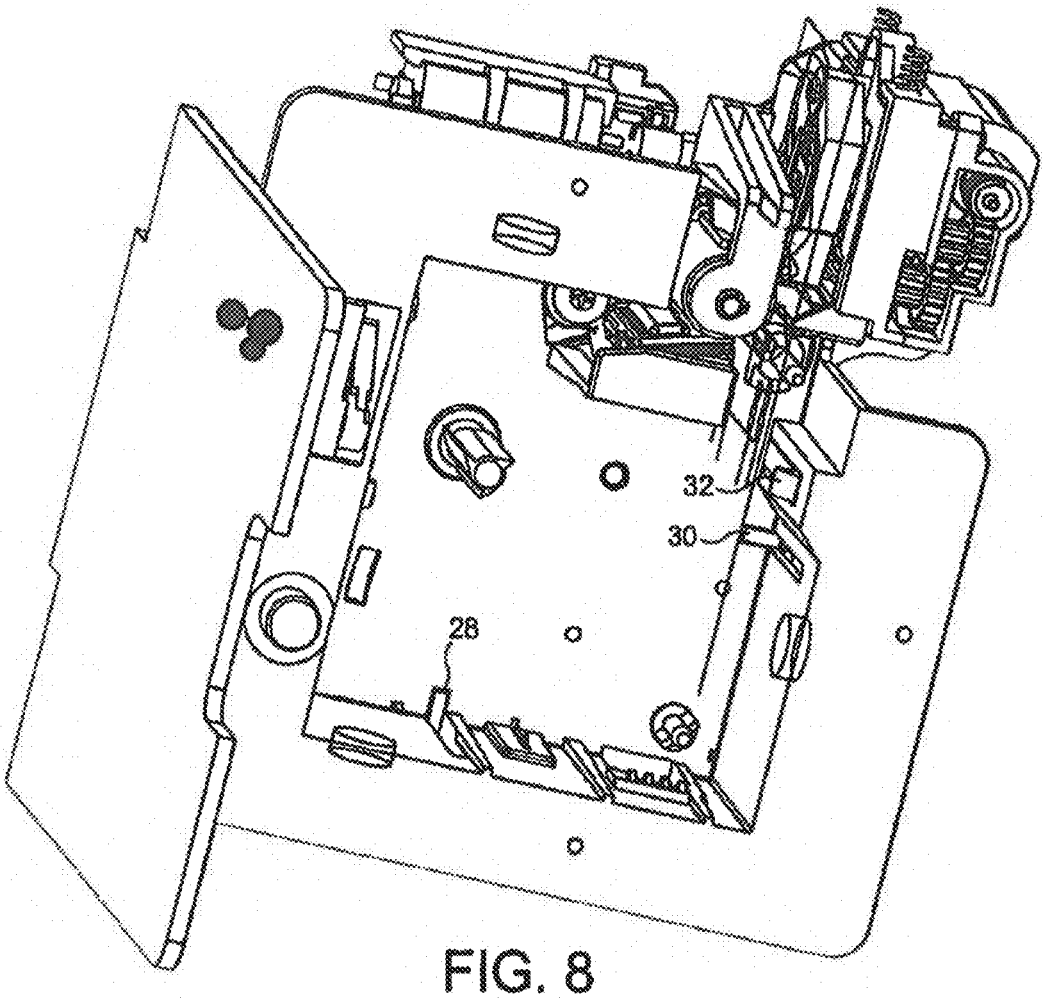
FIG. 8 is another top perspective view of the label printer shown in FIG. 7.
Figure 9:
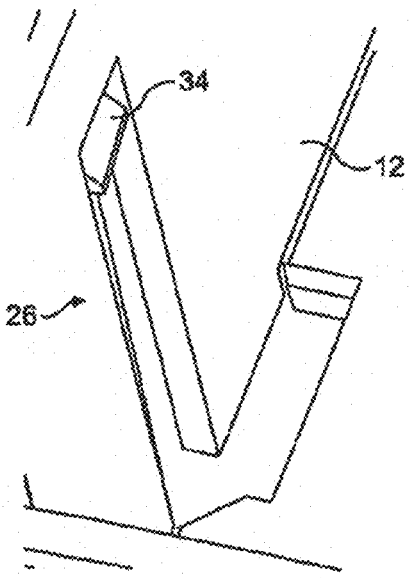
FIG. 9 is a view illustrating the position of the first locking element shown in FIG. 3 during insertion/ejection of a cassette.
Figure 10:
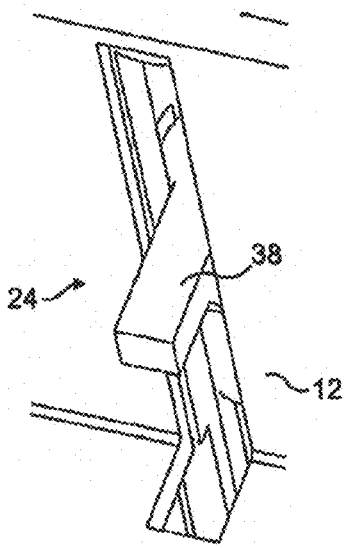
FIG. 10 is a view illustrating the position of the first ejector element shown FIG. 4 during insertion/ejection of a cassette.
Figure 11:
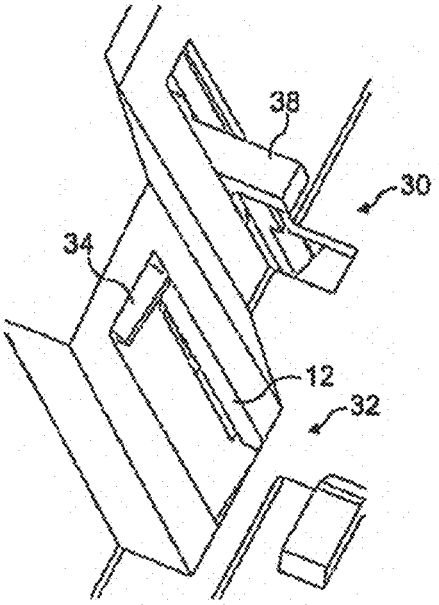
FIG. 11 is a view illustrating the positions of the second locking element and the second ejector element shown in FIG. 5 during insertion/ejection of a cassette.
Figure 12:
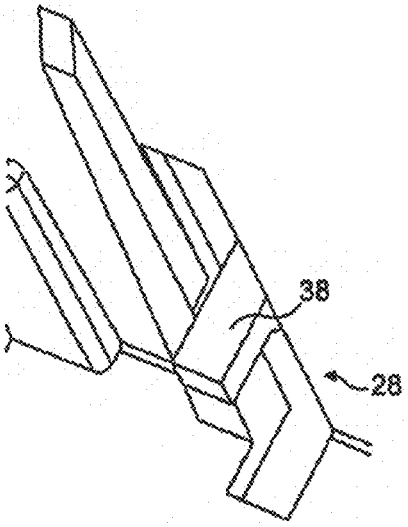
FIG. 12 is a view illustrating the position of the second ejector element shown in FIG. 6 during insertion/ejection of a cassette.

Referring to FIGS. 7 and 8, when a cassette is installed in the cassette-receiving bay 8, the first, second and third ejector elements 24, 28, 30 are pushed down to the base 10 and the first and second locking elements 26, 32 are in the locking position.

FIGS. 9, 10, 11 and 12 illustrate the positions of the locking and ejector elements 24, 26, 28, 30, 32 when the cassette is being inserted into the cassette-receiving bay 8. In FIGS. 9, 10, 11 and 12 the cassette is not shown for clarity.

During insertion, the cassette contacts the locking and ejector elements 24, 26, 28, 30, 32. The projections 34 of the locking elements 26, 32 have sloped upper surfaces such that as the cassette is inserted the locking elements 26, 32 are pushed backwards by the cassette into corresponding openings in the side walls 12. The locking elements 26, 32 are in their unlocked position. The locking elements 26, 32 are spring loaded to move into the locking position when the cassette is fully loaded as shown in FIGS. 7 and 8. The locking elements 26, 32 prevent the cassette from moving in an upward direction by interacting with locking features in the cassette. The ejectors 24, 28, 30 are spring loaded and cooperate with an underside of the cassette.

To eject a cassette, the ejector button 29 is actuated by a user pressing down on it, which unlocks the mechanism by moving the locking elements 26, 32 backwards into their corresponding openings in the side walls 12 of the cassette-receiving bay 8. The cassette is thus released and the ejectors 24, 28, 30 push the cassette upwards for easy removal from the printer 2.

Figure 13:
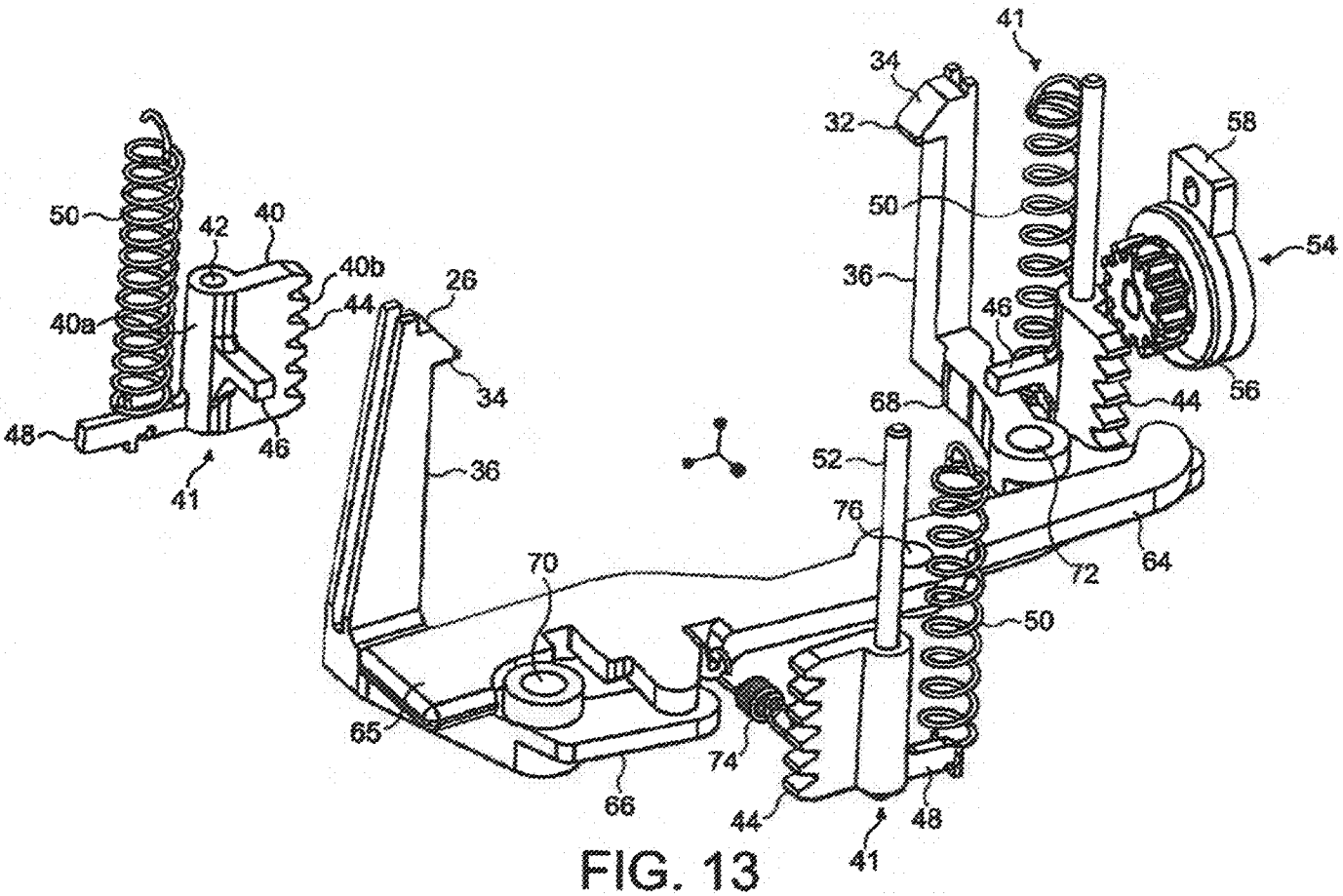
FIG. 13 is a view of the ejector mechanisms and the locking mechanism of the label printer of FIG. 1.

Referring to FIG. 13, the locking mechanism and the ejector mechanisms will now be described in more detail. The ejectors 41 each comprise a body portion 40. Adjacent to a first edge 40*a* thereof, the body portion 40 has hole 42 formed therethrough, the axis of the hole arranged so as to be parallel to the first edge 40*a* of the body portion 40. The hole 42 has a circular cross-section. Along a second edge 40*b* of the body portion 40, opposite the first edge 40*a*, the body portion 40 comprises a rack portion 44. An ejector element 46 extends perpendicularly from the plane of the body portion 40, which extends between the first and second edges 40*a*, 40*b*, from a point adjacent to the first edge 40*a* of the body portion 40, i.e. adjacent to the hole 42. The ejector element 46 is arranged so as to extend through a slit (not shown) in the side wall 12 of the cassette-receiving bay 8. Each ejector 41 further comprises a biasing member 48 at the bottom end of the first edge 40*a* of the body portion 40. The biasing member 48 extends in the plane of the body portion 40 perpendicular to the axis of the hole 42. The biasing member 48 is coupled to one end of an expansion spring 50, for biasing the ejector element 46 towards the top end of the corresponding slit (not shown) in the side wall 12 of the cassette-receiving bay 8. The top end of the slit in the side wall 12 is the end adjacent to the top opening of the cassette receiving bay 8, with the bottom end of the slit being that which is adjacent to the base 10 of the cassette receiving bay 8.

The body portion 40 of the ejector mechanism 41 is mounted on a shaft 52, which extends through the hole 42 in the body portion 40. A damper 54 is disposed adjacent to the rack portion 44 of the body portion 40. The damper 54 comprises a pinion (or gear) 56 which is rotatably mounted to a damper mount part 58.

Figure 14:
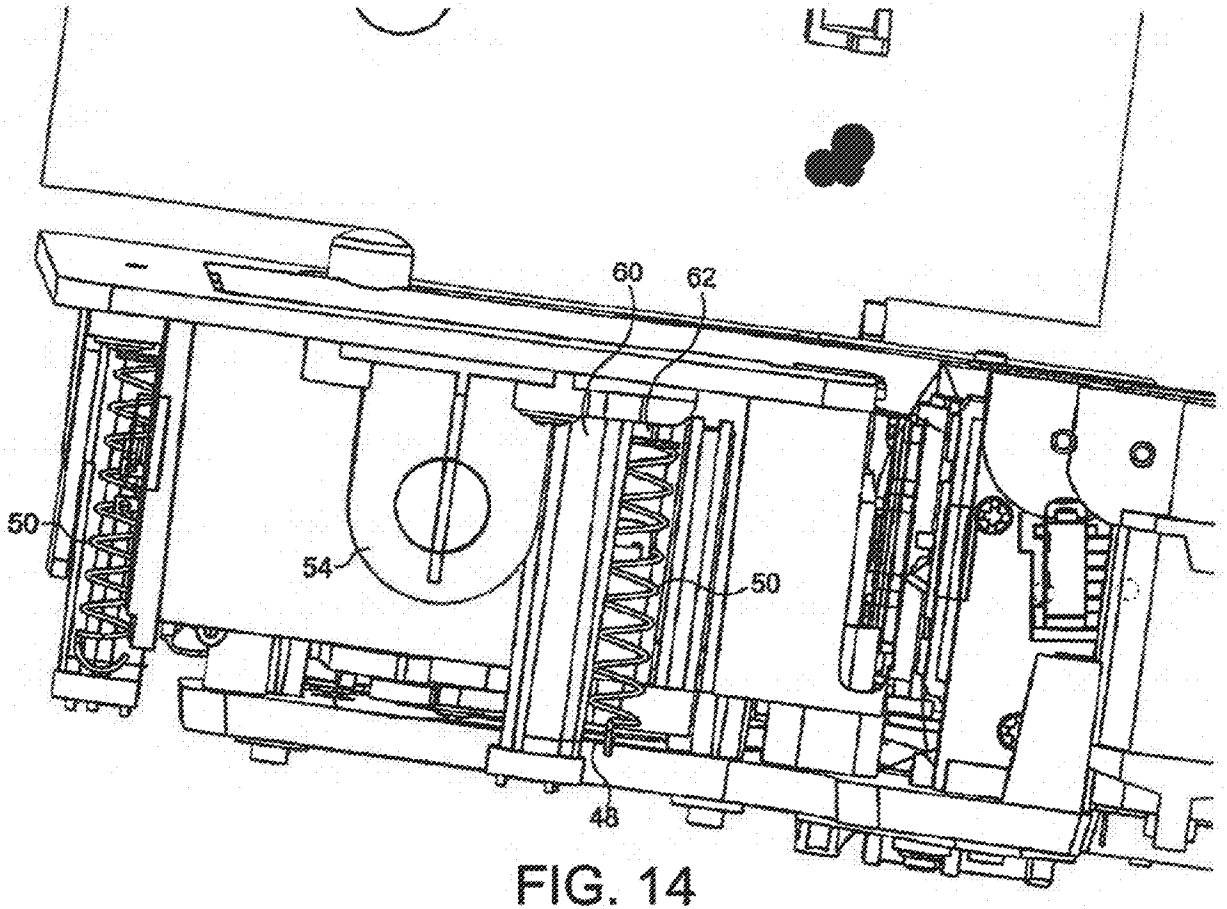
FIG. 14 is a side perspective view of the right hand side of the label printer of FIG. 1, showing an ejector mechanism.

FIG. 14 shows an ejector mechanism 41 of the label printer 2. As can be seen from FIG. 14, the ejector mechanism 41 comprises an ejector housing 60. The ejector housing 60 is approximately cylindrical in shape. The shaft 52 of the ejector mechanism 41 is disposed so as to be co-axial with the ejector housing 60. Accordingly, the body portion 40 is slidably mounted within the ejector housing 60, by means of the shaft 52 passing through the hole 42 formed at the first end 40*a* of the body portion 40. The ejector housing 60 comprises a first elongate opening along its length (not shown). The first elongate opening of the ejector housing 60 is aligned with a corresponding slit formed in a side wall 12 of the cassette receiving bay 8. The ejector element 46 of the ejector mechanism 41 protrudes into the cassette-receiving bay 8 through the first elongate opening and through the slit in the side wall 12, so as to interact with a cassette. The ejector housing 60 further comprises a second elongate opening (not shown) through which the biasing member 48 of the body portion 40 extends. As can be seen in FIG. 14, the biasing member 48 is attached to the lower end of the spring 50, i.e. the end of the spring 50 closest to the base 10 of the cassette receiving bay 8. The ejector housing 60 comprises a fixed extension 62 disposed at an upper end of the housing 60, adjacent to the top of the second elongate opening. The upper end of the spring 50 is attached to the fixed extension 62. Accordingly the spring 50 acts so as to bias the body portion 40 of the ejector mechanism 41 towards the upper end of the housing 60. The ejector housing 60 further comprises a third elongate opening (not shown), through which the rack portion 44 at the second edge 40*b* of the body portion 40 extends. The third elongate opening is aligned relative to a damper 54, such that the rack portion 44 meshes with the pinion 56 of the damper 54.

Figure 15:
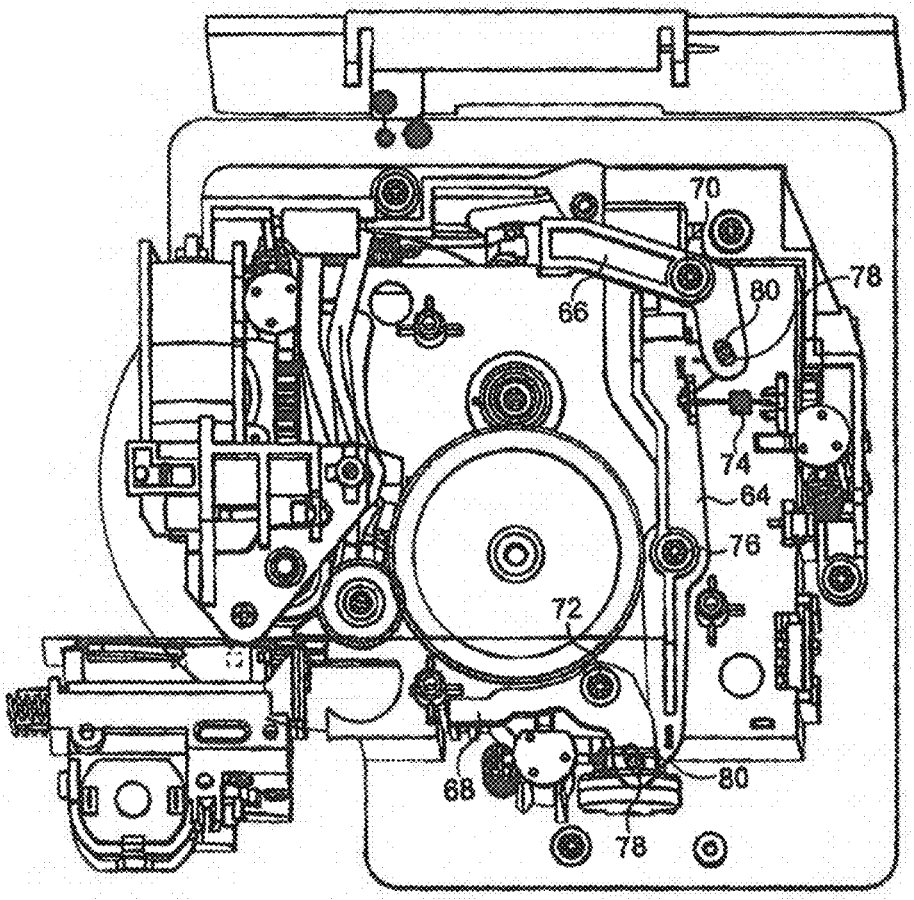
FIG. 15 is a bottom perspective view of the label printer of FIG. 1.

Referring to FIGS. 13 and 15, the locking mechanism will now be described in more detail. The locking mechanism comprises the two locking elements 26, 32. As described previously, the locking elements 26, 32 each comprise an elongate element 36 and a projection 34. Each projection 34 has a sloped upper surface for cooperating with a cassette inserted into the cassette-receiving bay 8 for moving the locking elements 26, 32 from the locking position to the unlocked position. The locking elements 26, 32 are coupled together by an actuating bar 64. Each of the locking elements 26, 32 is coupled to the actuating bar 64 by a respective coupling member 66, 68 extending in a perpendicular direction relative to the locking element. The locking elements 26, 32 have respective centres of rotation 70, 72 on opposite sides of the actuating bar 64 to each other. The centres of rotation 70, 72 comprise pivot points attached to the printer body 4. A return spring 74 is provided for biasing the locking elements 26, 32 towards the locking position. The actuating bar 64 has a centre of rotation 76, which also comprises a pivot point attached to the printer body 4. The first locking element 26 is rotatably coupled to the actuating bar 64 by means of a slot 78, provided in the distal end of the coupling member 66 relative to the first locking element 26, which cooperates with a pin 80 provided at a first end 65 of the actuating bar 64. The second locking element 32 is similarly rotatably coupled to a second end of the actuating bar 64.

Figure 16:
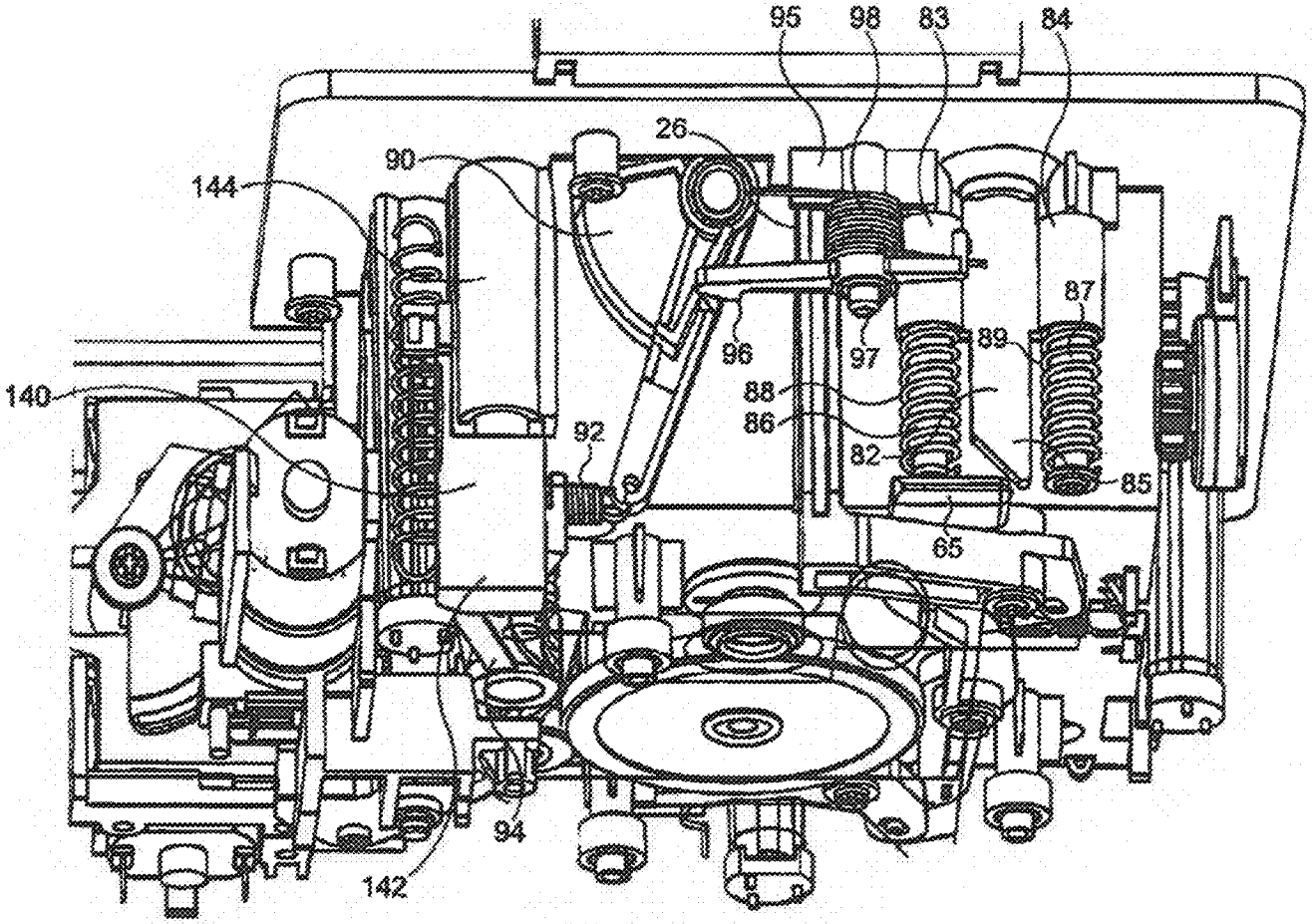
FIG. 16 is a side perspective view of the left hand side of the label printer of FIG. 1, showing a print head stop mechanism according to the present invention, when the lid of the label printer is open and no cassette is inserted.

Referring to FIG. 16, the ejector button 29 is disposed adjacent to the cassette-receiving bay 8, so as to be pressed by a user to eject a cassette from the cassette-receiving bay 8 when the lid 6 is open and a cassette is inserted. The ejector button 29 comprises an actuator part 82. The upper end of the actuator part (not shown) has a circular cross-section and extends through an opening in the upper surface of the label printer 2, such that it can be pressed by a user. The lower end of the actuator part 82 comprises first and second tubular portions 83, 84 and a flange part 85 disposed therebetween. The flange part 85 of the ejector button actuator part is angled at the lower end thereof, at an angle of approximately 45°. First and second button guide shafts 86, 87 are mounted to the printer body 4 and pass through the first and second tubular portions 83, 84 of the actuator part 82, respectively, so as to guide the motion of the actuator part 82 when pressed by a user. First and second eject button springs 88, 89 are disposed on the first and second guide shafts 86, 87, respectively, so as to bias the actuator part 82 towards the top of the label printer 2.

Figure 17:
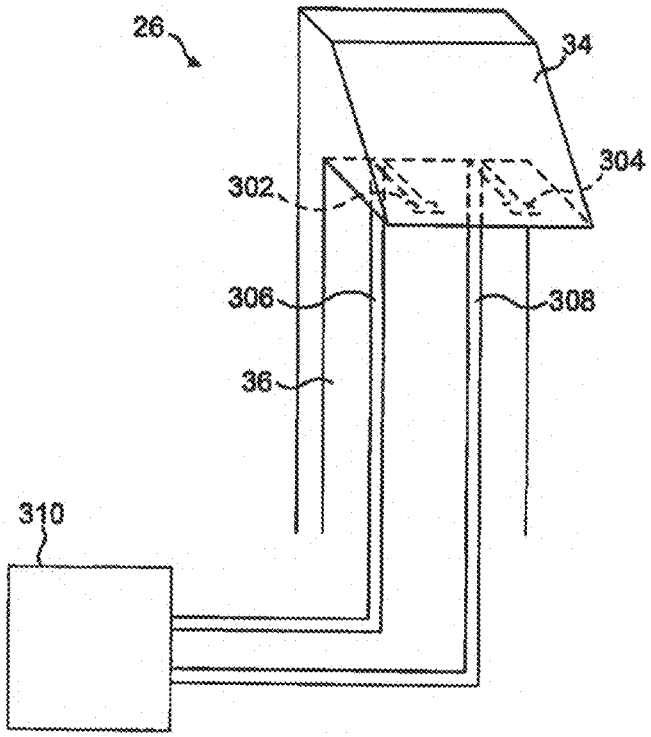
FIG. 17 is an enlarged view of the first locking element shown in FIG. 3, showing cassette detection means according to a first embodiment of the present invention.
Figure 29:
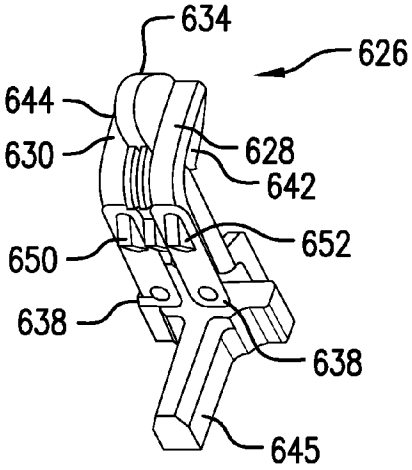
FIGS. 27 to 29 are each views of a locking element of a label printer according to an embodiment.
Figure 28:
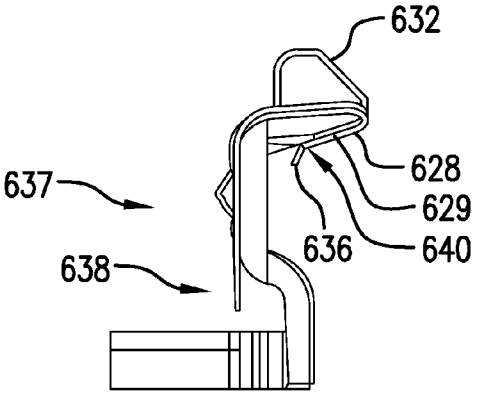
Figure 27:
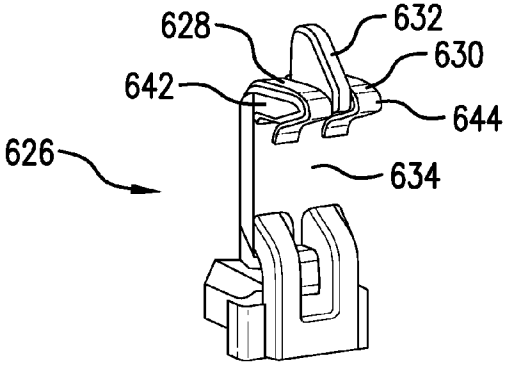

Referring to FIG. 17, the first locking element 26 comprises cassette detection. In this embodiment the cassette detection comprises first and second contact pads 302, 304, which are connected to cassette detection circuitry 310 by means of respective first and second conduction connections such as wires, conductive pads, conductive material, etc. 306, 308. These conduction connections will be referred to as wires in the following but as will be appreciated this is by way of example only and the wires can be replaced by any other suitable conduction arrangement. The first and second contact pads 302, 304 are disposed on the lower surface (that is the surface which engages the cassette) of the projection 34 of the first locking element 26. The first wire 306 is connected to the first contact pad 302 at one end and extends from the first contact pad 302 along the surface of the elongate element 36 and is connected at the other end to the cassette detection circuitry 310. Similarly, the second wire 308 connects the second contact pad 304 to the cassette detection circuitry 310. In the current embodiment of the present invention, the second locking element 32 is similarly provided with first and second contact pads 302, 304 which are connected to the cassette detection circuitry 310 via first and second wires 306, 308, respectively. A further example of a locking element is shown in FIGS. 27 to 29.

Figure 18:
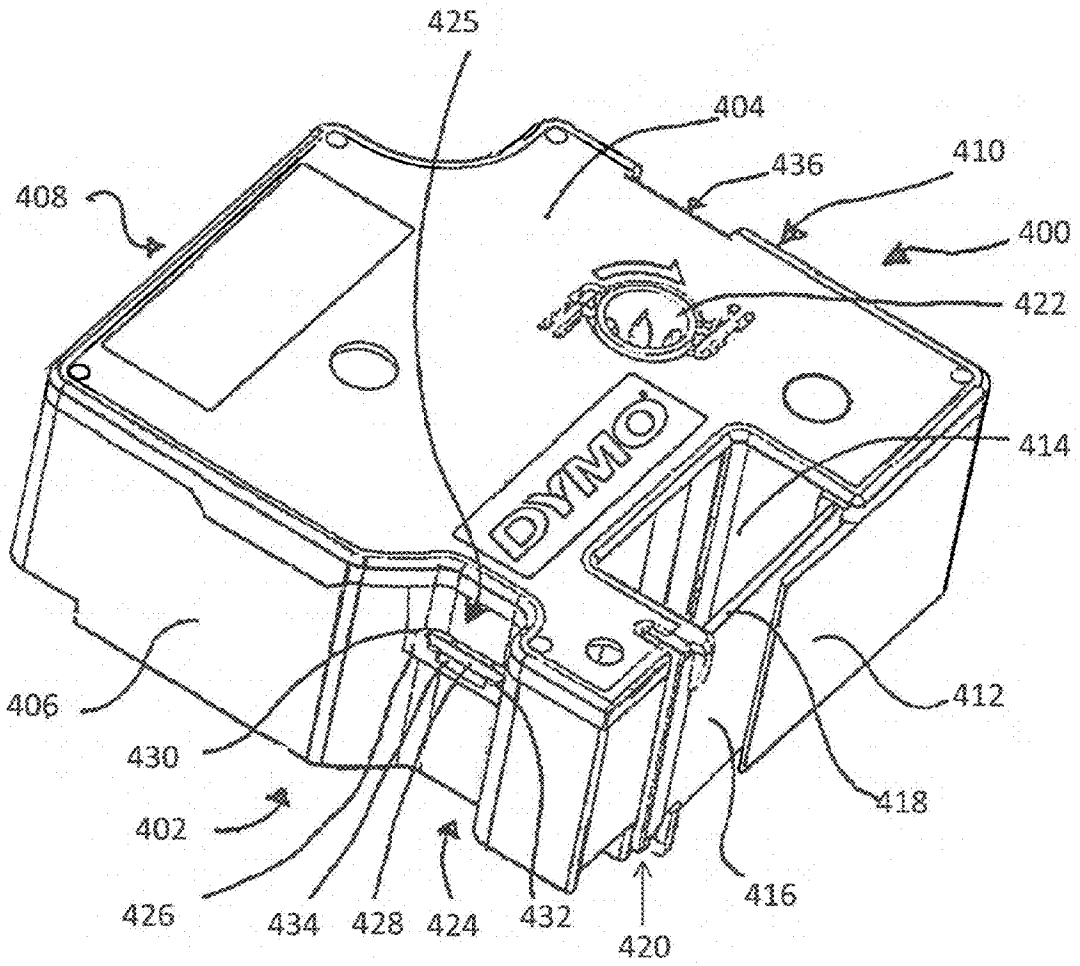
FIG. 18 is a view of a cassette according to an embodiment.

An example of a cassette according to an embodiment is shown in FIG. 18. The cassette 400 comprises a base 402, a top 404, and sides 406, 408, 410 and 412 connecting the base 402 to the top 404. The cassette 400 also comprises a recess 414 for accepting a print head when the cassette 400 is inserted in a label printer.

The cassette 400 also carries a supply of image receiving tape 416 and ink ribbon 418. After printing the image receiving tape passes out of the cassette via outlet 420 and the ink ribbon is taken up in the cassette 400 on ink ribbon take up spool 422.

Side 406 of the cassette comprises a recess 424. The recess 424 comprises a locking portion shown generally at 425. The locking portion 425 comprises a ledge portion 426 upon which is mounted an elongate conductive bar 428. The conductive bar 428 may be cylindrical or of any other cross-section such as square, rectangular, hexagonal etc. The conductive bar 428 is retained in seat portions, or receiving portions, 430 and 432 at either side of ledge 426. In the region between the seats 430 and 432 the conductive bar 428 is spaced from the surfaces of the cassette 400 and the ledge 426. That is the conductive bar 428 spans a trough portion 434 of ledge 426.

Figure 19:
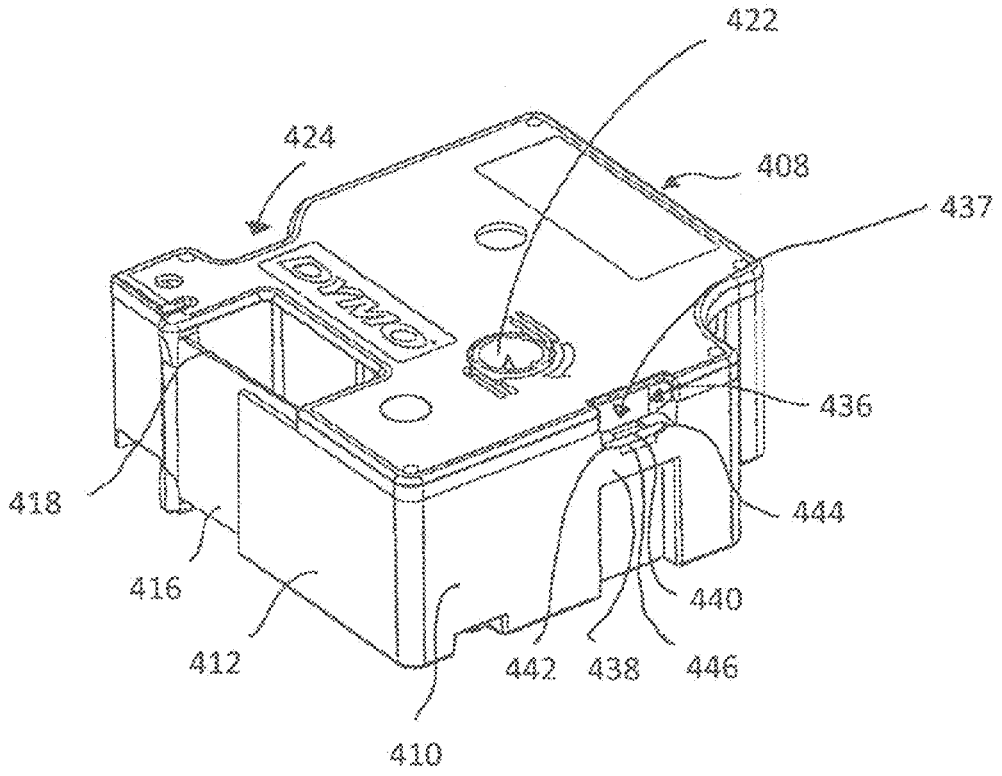
FIG. 19 is an alternative view of the cassette of FIG. 18.

A recess portion 436 of cassette 400 is more clearly shown in FIG. 19.

Similarly to the recess 424 described with respect to FIG. 18, recess 436 also comprises a locking portion shown generally at 437 comprising a ledge portion 438. Ledge portion 438 supports a second elongate conductive bar 440 which is retained at either end in seats, or receiving portions, 442 and 444 of ledge 438. The conductive bar 440 may be of any cross sectional shape such as cylindrical, square, rectangular, hexagonal etc. The conductive bar 440 spans a trough portion 446 of ledge 438.

Figure 21:
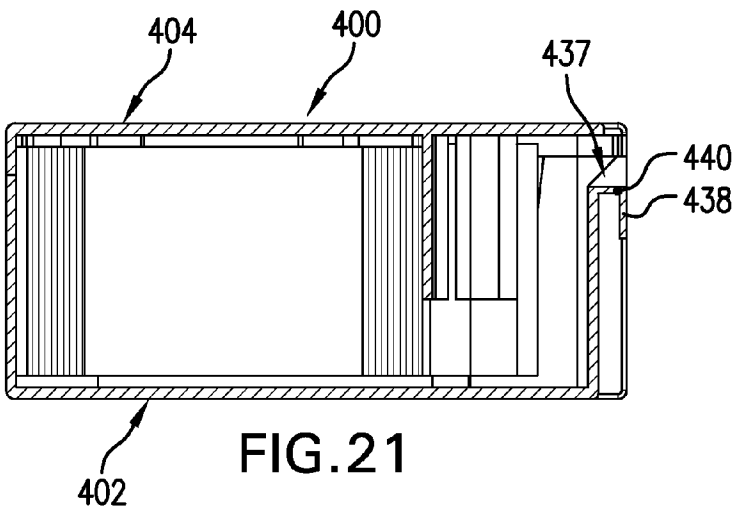
FIG. 21 is a cross-section of a side view of the cassette of FIG. 19.
Figure 20:
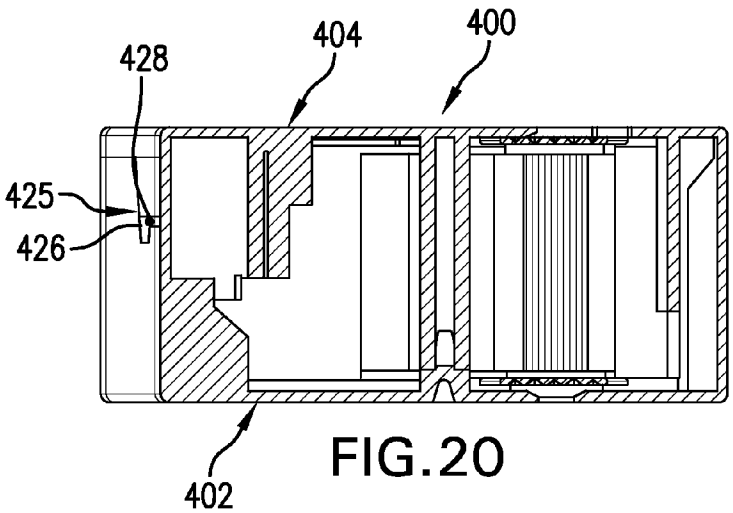
FIG. 20 is a cross-section of a side view of the cassette of FIG. 18.

FIGS. 20 and 21 are sectional views of the cassette 400.

FIG. 20 shows the positioning of the conductive bar 428 on the ledge 426. Whilst FIG. 20 shows the top surface of the bar 428 flush with the upper edge of the ledge 426 (i.e. in seats 432 and 430), it should be appreciated that in alternative embodiments the ends of the conductive bar 428 may sit proud of or be recessed in the seats 430 and 432.

FIG. 21 shows the positioning of the conductive bar 440 in the ledge 438. Again it should be appreciated that although the ends of the conductive bar 440 are shown as flush with the seats 440 and 442 of the ledge 438, in alternative embodiments the conductive bar 440 may sit proud of or be recessed in the seats 442 and 444.

Figure 21A:
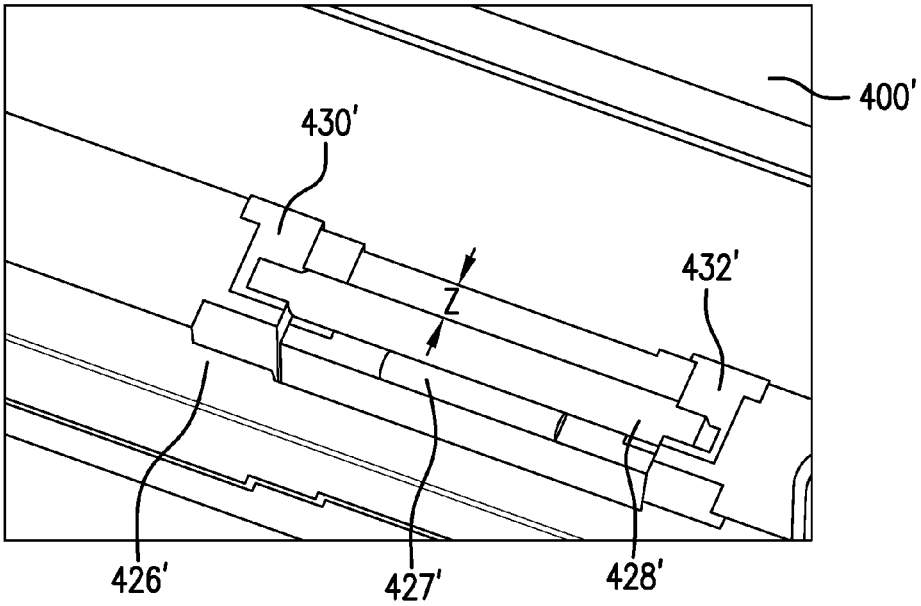
FIG. 21A is an isometric view of a portion of a cassette according to an embodiment.

FIG. 21A shows a further embodiment of a cassette 400'. Conductive bar 428' is located on a ledge portion 426'. More particularly the conductive bar 428' is located between receiving portions 430' and 432'. The conductive bar 428' may be a friction fit with the receiving portions 430' and 432', such as a push-fit or a snap-fit. Alternatively the conductive bar 428' may be attached to the receiving portions 430' and 432' with an adhesive, such as glue. Alternatively the conductive bar 428' can be in-moulded during an injection moulding process. Cassette 400' also comprises rib 427' which protrudes from the upper surface of ledge 426'. The rib 427' is positioned proximate to conductive bar 428'. The rib 427' has a longitudinal axis which extends laterally of, and parallel to, longitudinal axis of conductive bar 428'. The rib 427' may be of any cross-sectional shape such as square, circular, semi-circular etc. The rib 427' may act as a guide to help ensure that the conductive bar 428' is correctly located between receiving portions 430' and 432' when inserted. The rib 427' also acts as a wall to stop the conductive bar 428' from springing out of the receiving portions 430' and 432'. The rib 427' also prevents the conductive bar 428' from being removed easily from the cassette, and therefore may prevent inadvertent removal of the conductive bar 428'. In some embodiments the rib 427' is slightly spaced from the conductive bar 428'. In another embodiment the rib 427' engages the conductive bar 428'. In such an embodiment the conductive bar 428' is frictionally engaged with receiving portions 430' and 432' and rib 426', once correctly inserted. It can also be appreciated from this Figure that the conductive bar 428' is spaced from a sidewall of cassette 400' by a distance Z. It should be appreciated that Z can be of any distance, including zero (in which case the conductive bar 428' will also be in contact with the sidewall of the cassette.

The operation of the above described locking mechanism, ejector mechanisms and cassette detection means will now be described. When there is no cassette inserted in the cassette-receiving bay 8, the spring 50 of each ejector mechanism 41 is in an unextended state and, accordingly, each ejector element 24, 28, 30 is disposed at the top end of the corresponding slot in the side wall 12 of the cassette-receiving bay 8. The locking elements 26, 32 of the locking mechanism are biased towards the locking position, by means of the return spring 74 acting on the actuating bar 64.

When a cassette is inserted into the cassette receiving bay 8, the base of the cassette presses down on each ejector element 24, 28, 30. This, in turn, causes the body portion 40 of each ejector to move downwards along the shaft 52 and causes the spring 50 to extend. As the body portion 40 moves downwards, the rack portion 44 is meshed with the pinion 56 of the damper 54. Accordingly, the pinion 56 of the damper 54 is rotated as the cassette is inserted and provides a resistance to the force applied to the cassette by a user who inserts the cassette into the cassette receiving bay 8. The resistance provided by the pinion 56 engaging with the rack portion 44 is preferably selected so as not to be so great that a user requires excessive force to insert a cassette into the cassette-receiving bay 8, which could damage components of the ejector mechanisms.

When the cassette has been inserted fully into the cassette-receiving bay, the locking elements 26, 32 engage with corresponding portions of the cassette, so as to hold the cassette in the cassette-receiving bay 8 against the force exerted on the base of the cassette by the ejector elements 24, 28, 30. More specifically, the projection 34 of the first locking element 26 engages with conductive bar 428 of the cassette 400. Accordingly, the first and second contact pads 302, 304 of the first locking element 26 are in contact with the conductive bar 428. The conductive bar 428 is dimensioned such that a conductive connection between the first and the second pad is created when the locking element engages the conductive bar 428. Similarly, the projection 34 of the second locking element 32 engages with conductive bar 440. Accordingly, the first and second contact pads 302, 304 of the second locking element 32 are in contact with the conductive bar 440 of the cassette 400. The conductive bar 440 is dimensioned such that a conductive connection is created between the first and the second pad when the locking element engages the locking member.

The cassette detection circuitry 310 may detect the engagement of the first and second locking elements 26, 32 with the conductive bars 428 and 440 of the cassette, by measuring the resistance, voltage or current, or by substituting the measured value into an analog or digital measurement between the first and second contact pads 302, 304 of each locking element 26, 32. For example, if a voltage is applied to the first contact pad then a current will flow between the first and second contact pads 302, 304, via the respective conductive bars 428 and 440. Accordingly, the cassette detection circuitry can determine whether the first and second locking elements 26, 32 are properly engaged with the cassette by detecting the flow of the current.

Figure 22:
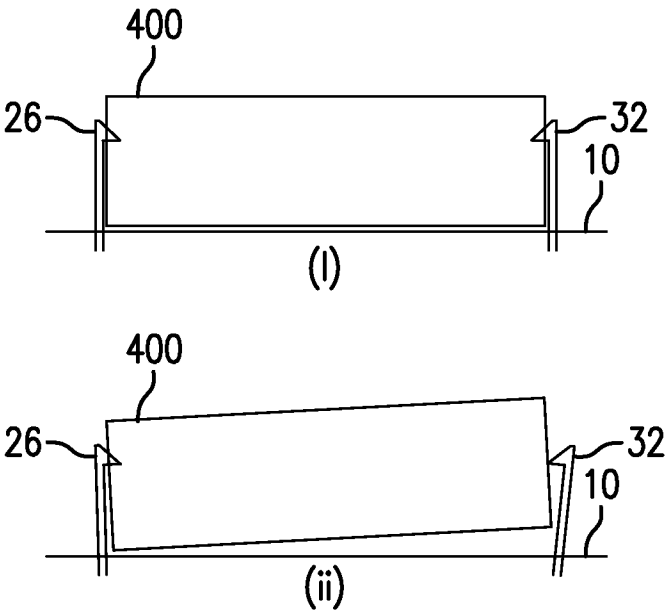
FIG. 22 is a schematic representation of a cassette inserted in a cassette receiving bay where: (i) the first and second locking elements are properly engaged with the cassette; and (ii) the first locking element is properly engaged with the cassette and the second is not engaged with the cassette.

Referring to FIG. 22(*i*), when the cassette is correctly inserted and both the first and second locking elements 26, 32 are properly engaged, the cassette detection circuitry determines that the cassette is correctly inserted and printing may be commenced. Referring to FIG. 22(*ii*), it is possible that one of the locking elements will not be properly engaged with the cassette if, for example, the cassette is inserted with an uneven force. In this case, no current will flow between the first and second contact pads 302, 304 of the second locking element 32 because the first and second contact pads 303, 304 are not in contact with the conductive bar 440 of cassette 400. The cassette detection circuitry will determine that the second locking element 32 is not engaged properly with the cassette.

When it is determined by the cassette detection circuitry that one or more of the locking elements 26, 32 is not properly engaged with the cassette, a label printer controller (not shown) may control the label printer to prevent printing. Furthermore, the controller may inform a user via a display means (not shown), which may be a liquid crystal display, that the cassette is not properly inserted. In the present embodiment, the cassette detection circuitry is operable to determine which of the one or more locking element 26, 32 is not properly engaged with the cassette. Accordingly, the controller may inform the user via the display means, as to which locking element/s are not engaged with the cassette and may further inform the user as to what action is required in order to correctly insert the cassette. For example, the control may display a diagram similar to FIG. 22(*ii*) on the display means, to indicate which side of the cassette must be pressed in order for the cassette to be inserted properly. Such an indication may also be displayed in the event that one or more of the locking elements disengages from the cassette, for example, as a result of the printer being dropped and subjected to a sudden impact. The latter may also be displayed in the event that one or more of the locking elements disengages from the cassette during transport of the label printer with a cassette installed.

Once the cassette has been inserted correctly, the cassette detection circuitry detects the engagement of the locking elements 26, 32 with the cassette and the controller enables printing to commence.

After printing, a cassette may be ejected by a user pressing the eject button 29. When the eject button 29 is pressed, the downward movement of the actuating part 82 causes the angled flange part 85 to push against the first end 65 of the actuating bar 64. Referring again to FIG. 15, the actuating bar 82 rotates around its centre of rotation 76 in an anti-clockwise direction (as viewed). Accordingly, the coupling member 66 of the first locking element 26 rotates clockwise around centre of rotation 70, thereby moving the first locking element 26 to the unlock position. At the same time, the coupling member 68 of the second locking element 32 rotates anti-clockwise around centre of rotation 72, thereby moving the second locking element 32 to the unlock position.

With the locking elements 26, 32 in the unlock position, the cassette is free to move under the force exerted by the ejector elements 24, 28, 30. As the expansion springs 50 of the ejector mechanisms 41 contract, the ejector elements 24, 28, 30 move up their corresponding slits in the side walls 12 of the cassette-receiving bay 8 and push the cassette out of the cassette receiving bay 8. At the same time, the rack portion 44 of each ejection mechanism 41 is meshed with the pinion 56 of the corresponding damper 54. Accordingly, the engagement of the rack portion 44 and the pinion 56 provides a resistance to the upward movement of the ejector elements 24, 28, 30. Thus, by employing a damper 54, the acceleration of an ejector element in the upward direction under the force of the expansion spring 50 is reduced. The cassette is thus gradually ejected from the cassette-receiving bay 8. The degree of resistance provided by the pinion 56 of the damper 54 may be determined by the viscosity of oil used to lubricate the pinion with respect to the damper mount part 58.

In an alternative embodiment of the present invention, only one of the locking elements may be provided with contact pads for detecting engagement of that particular locking element with the cassette. In this case the user may be informed of whether or not the locking element provided with the contact pads is properly engaged with the cassette. Preferably, the one locking element provided with contact pads is positioned adjacent the print head such that it is detected that the cassette is positioned correctly adjacent the position where the image is formed on the tape. In another embodiment, the label printer is only provided with a single locking element for retaining a cassette in the cassette receiving bay. In this case, the single locking element could be provided with contact pads for detecting the insertion of a cassette as described above. Preferably, the single locking element is positioned adjacent the print head.

Figure 23:
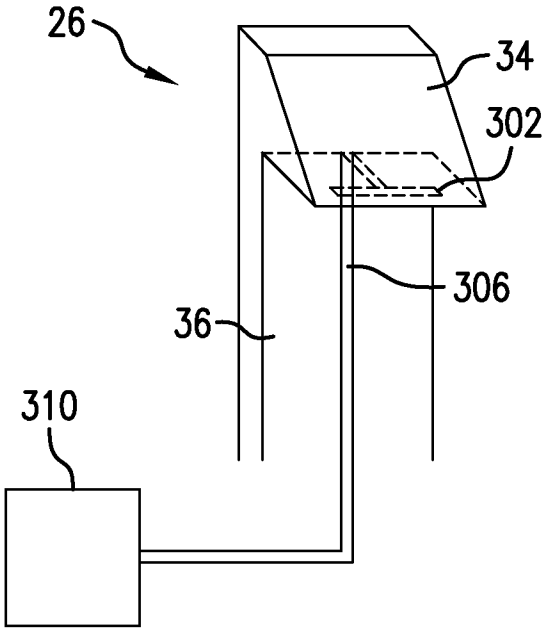
FIG. 23 is an enlarged view of the first locking element shown in FIG. 3, showing cassette detection means according to an alternative embodiment of the present invention.

Referring to FIG. 23, in yet another embodiment of the present invention, the first locking element 26 is provided with a single contact pad 302 which is connected to cassette detection circuitry 310 by conductive connection 306, which can of course take any suitable format such as a wire or the like. Similarly, the second locking element 32 is provided with a single contact pad which is connected to the cassette detection circuitry 310 by means of a conductive connection such as a wire 306 or the like.

Figure 24:
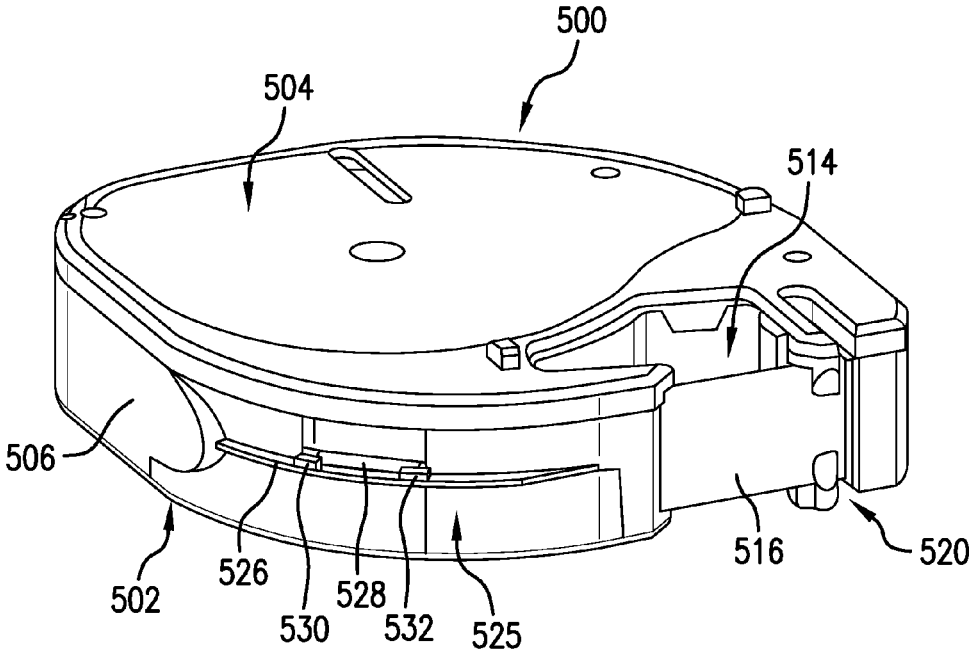
FIG. 24 is a view of a cassette according to a further embodiment.

A cassette according to another embodiment is shown in FIG. 24. The cassette 500 comprises a base 502, top 504 and a side 506 connecting the base 502 to the top 504. A supply of image receiving tape 516 is contained within the cassette 500 and after printing exits the cassette via outlet 520. The cassette 500 also comprises a recess 514 for accepting a print head when the cassette is inserted in a label printer.

The cassette 500 also comprises a locking portion shown generally at 525, similar to the locking portion of the cassette shown in FIGS. 18 and 19.

The locking portion 525 comprises a rib or ledge 526 which extends around side 506 of the cassette 500. Seats 530 and 532 sit on an upper surface of ledge 526, and a conductive bar 528 is supported at either end by the seats, or receiving portions, 530 and 532.

Figure 25:
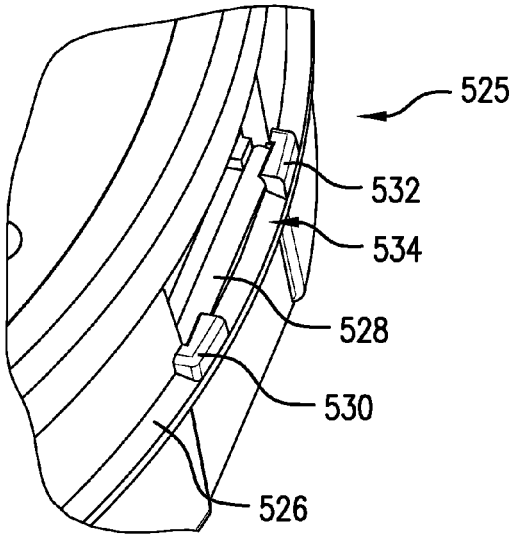
FIG. 25 is a detailed view of a portion of the cassette of FIG. 24.
Figure 26:
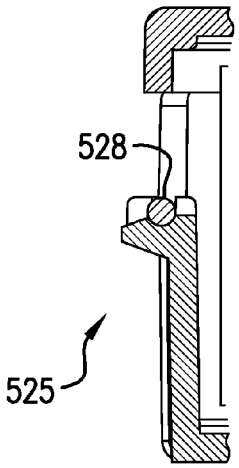
FIG. 26 is a sectional view of a portion of the cassette of FIG. 25.

The locking portion 525 is shown in more detail in FIGS. 25 and 26.

From FIG. 25 it can be seen how the conductive bar 528 is supported by seats 530 and 532. The locking portion 525 also comprises a trough portion 534 which is spanned by the conductive bar 528 between the seats 530 and 532. Again, the conductive bar 528 maybe of any cross sectional shape.

FIG. 26 shows a cross section through the cassette 500. Between the seats 530 and 532 a lower edge of the conductive bar 528 rests in the trough 534, with an upper portion of the conductive bar sitting proud of the trough 534. In another embodiment the conductive bar may be spaced from the surfaces of the cassette 500 in the region between the seats 530 and 532.

Figure 32:
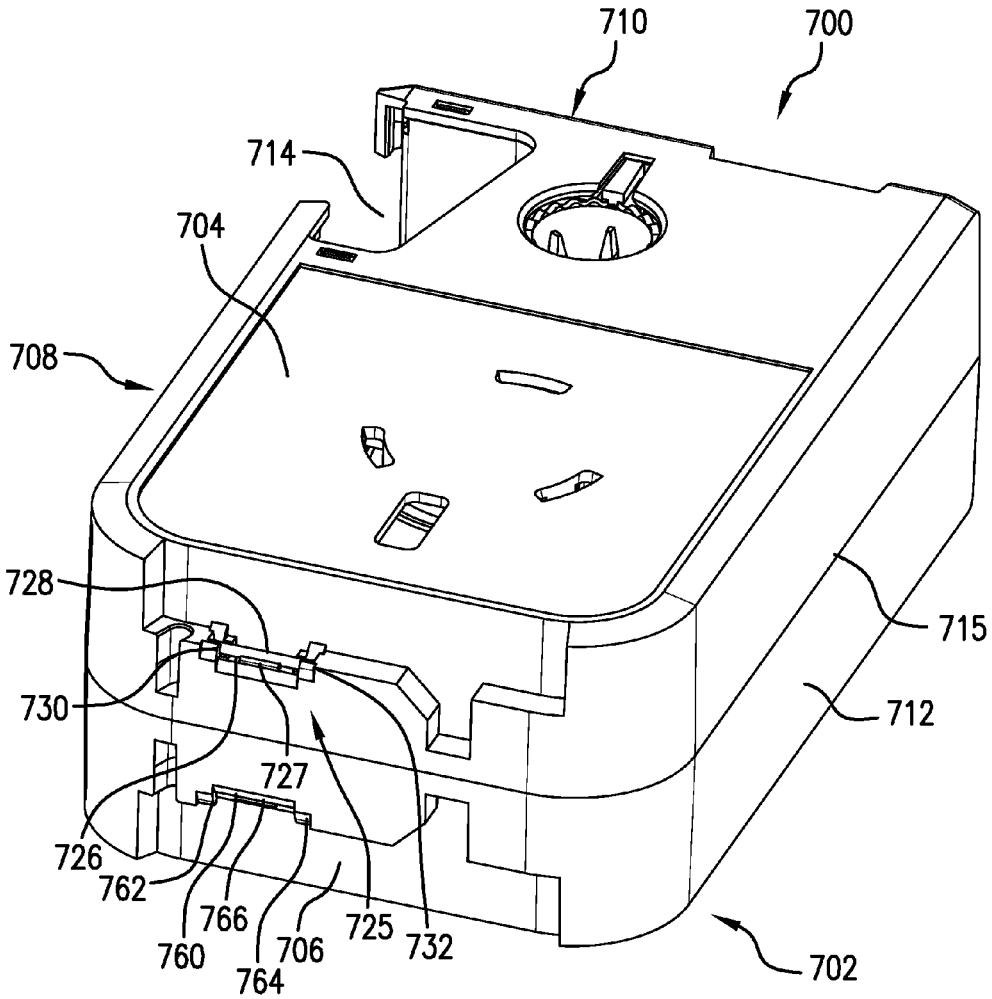
FIG. 32 is a perspective view of a cassette according to a further embodiment.

FIG. 32 shows a cassette according to a further embodiment. The cassette 700 comprises a base 702, a top 704 and sides 706, 708, 710 and 712. The cassette also comprises a printhead recess 714. Certain features of the cassette are symmetrical about a centre line 715. For example a locking portion 725 is symmetrical about centre line 715. This allows the cassette 700 to be used in two types of cassette receiving bays, where those cassette receiving bays mirror each other.

The locking portion 725 comprises a first conductive bar 728 which is received at either end by seat portions or receiving portions 730 and 732. The conductive bar 728 is positioned above a ledge portion 726, upon which is mounted elongate rib 727.

The locking portion 725 also comprises a second conductive bar 760 which is received at either end by seat portions or receiving portions 762 and 764, and elongate rib 766 which is positioned adjacent conductive bar 760.

Figure 33:
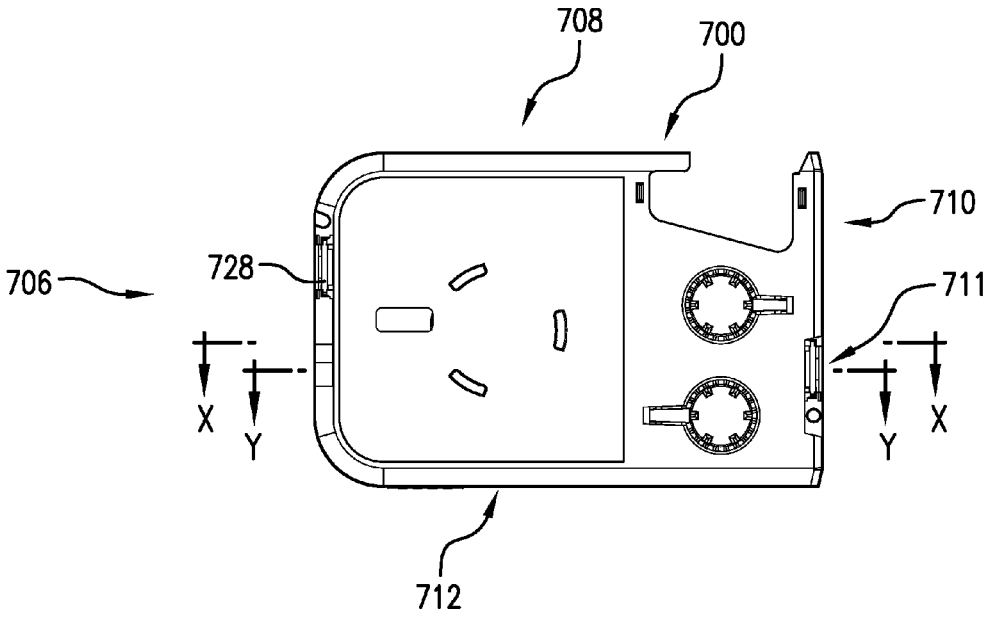
FIG. 33 is a plan view of the cassette of FIG. 32.

FIG. 33 is a plan view of the cassette 700. The conductive bar 728 is visible from this view. It can also be appreciated that a further locking portion 711 comprising one or more conductive bars (similar to the side shown in FIG. 32) is also present on side 710.

Figure 33B:
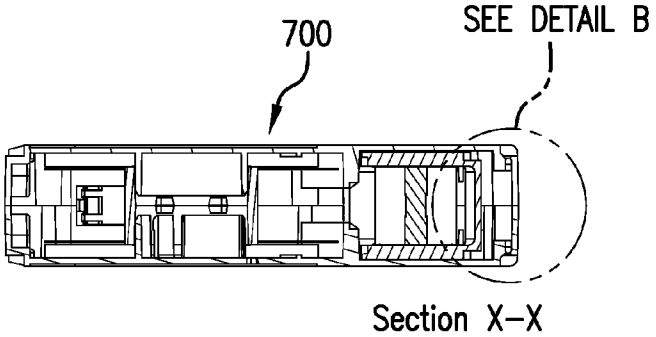
FIG. 33B is a second sectional view of the cassette of FIG. 32.
Figure 33A:
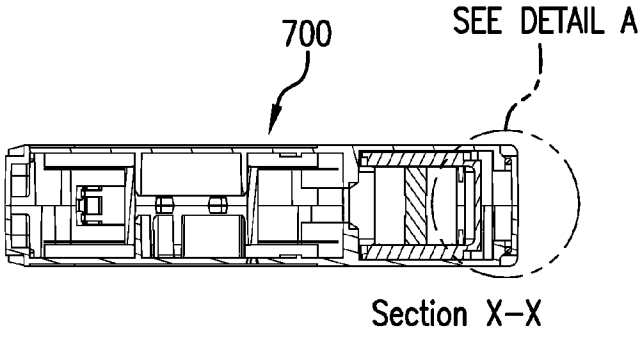
FIG. 33A is a first sectional view of the cassette of FIG. 32.

FIG. 33A is a sectional view of cassette 700 through section X-X. In this figure the conductive bars are present in the cassette. See FIG. 34 for detail A.

FIG. 33B is a sectional view of cassette 700 through section X-X. In this figure the conductive bars are omitted. See FIG. 35 for detail B.

Figure 33D:
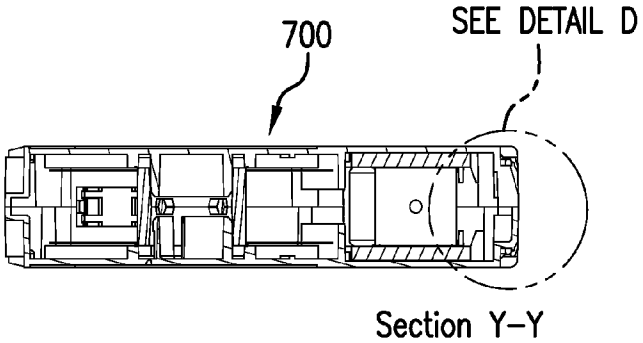
FIG. 33D is a fourth sectional view of the cassette of FIG. 32.
Figure 33C:
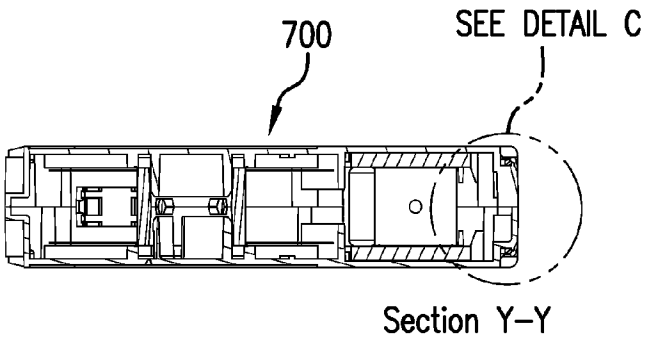
FIG. 33C is a third sectional view of the cassette of FIG. 32.

FIG. 33C is a sectional view of cassette 700 through section Y-Y. In this figure the conductive bars are present in the cassette. See FIG. 36 for detail C.

FIG. 33D is a sectional view of cassette 700 through section Y-Y. In this figure the conductive bars are omitted. See FIG. 37 for detail D.

Figure 34:
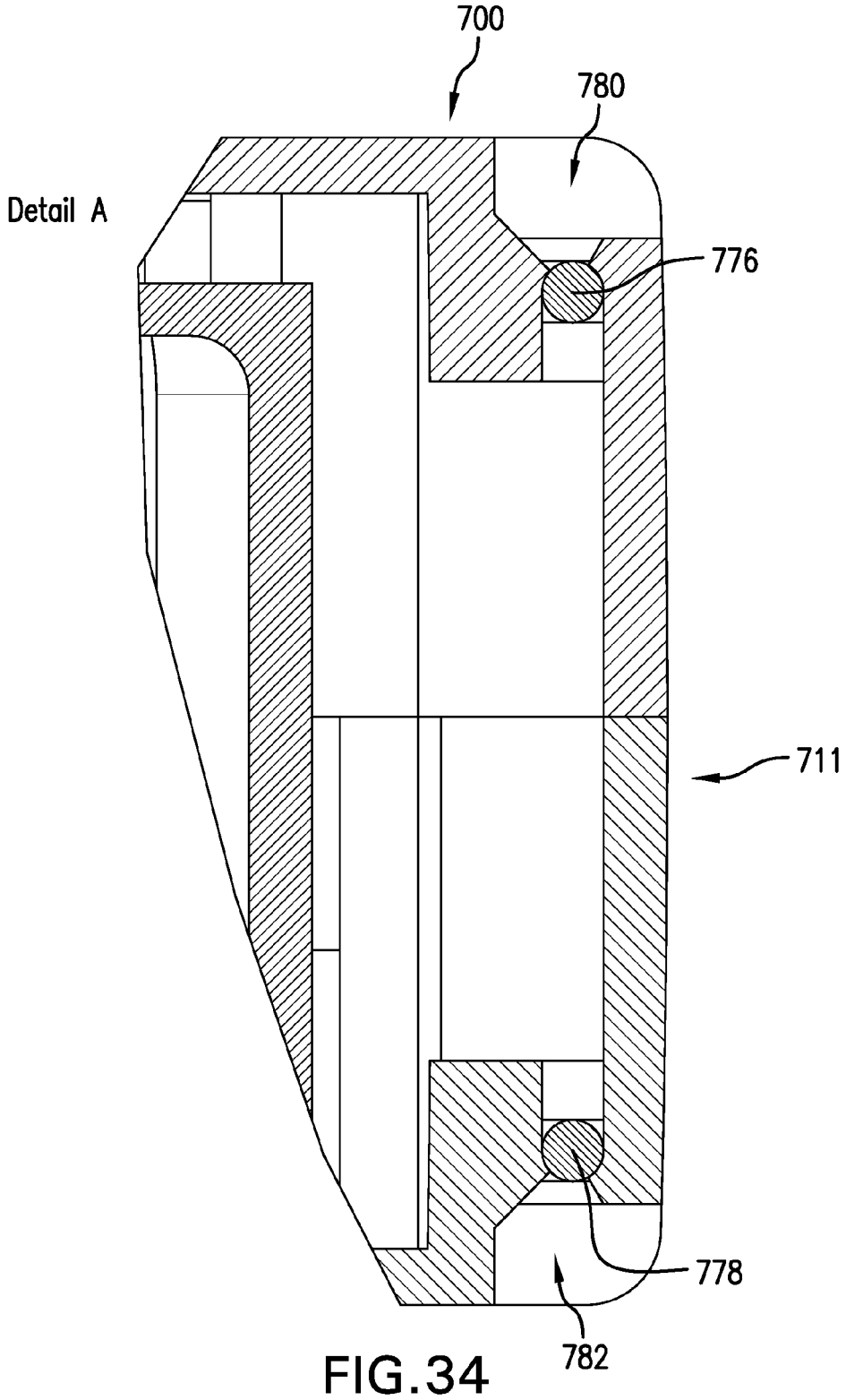
FIG. 34 is a detailed view of FIG. 33A.

FIG. 34 shows detail A of FIG. 33. Detail A shows a sectional view through conductive bars 776 and 778 of locking portion 711. Conductive bar 776 is received in a receiving portion or seat portion 780, and conductive bar 778 is housed in receiving portion or seat portion 782.

Figure 35:
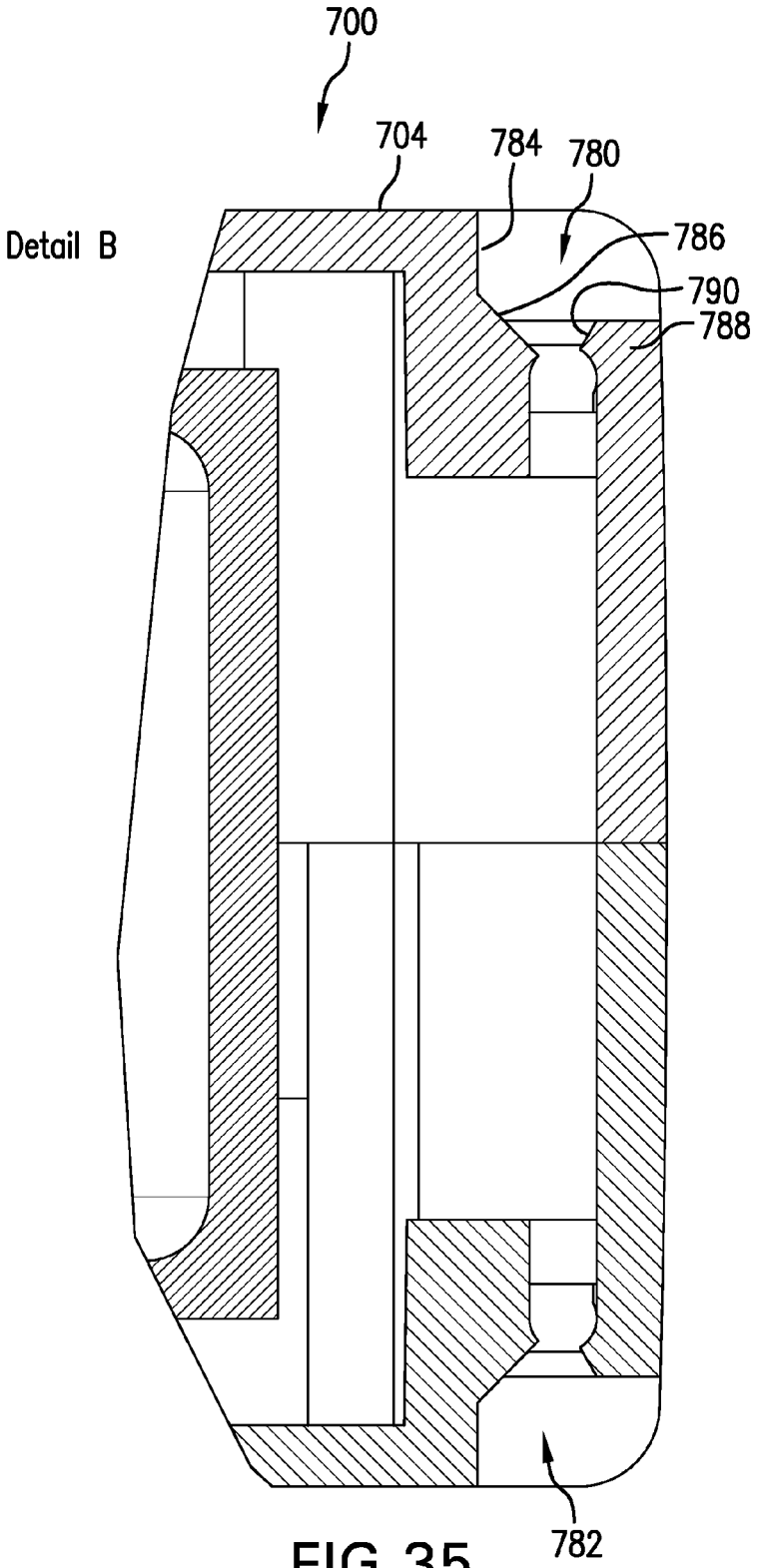
FIG. 35 is a detailed view of FIG. 33B.

FIG. 35 shows detail B. In this figure the conductive bars 776 and 778 are omitted for clarity. From this figure it can be appreciated that the receiving portion 780 tapers up to a back wall 784 which extends vertically to meet top 704 of the cassette. That is the back wall 784 joins to tapering wall 786 which tapers down to the region where the conductive bar 776 is housed (as shown in FIG. 34). The receiving portion 780 also comprises region 788 which has a face 790 which also tapers to meet the region where the conductive bar 776 is housed.

These tapering walls facilitate insertion of the conductive bar 776. The tapering surfaces 786 and 790 act as a guide to smoothly and correctly locate the conductive bar 776 as it is being inserted. The back wall 784 being laterally spaced from where the conductive bar 776 is located also provides room for a user's hand or automated item of machinery when inserting the conductive bar 776 (this can be further appreciated from FIG. 42).

There is also some elasticity or flexibility in the materials forming the seats or receiving portions of the conductive bars. As such that the seats can spring apart slightly to allow insertion of the conductive bar, and then spring back again to their original position so as to securely hold the bar.

It will be appreciated that receiving portion 782 is similarly structured. This structure also applies to other regions of the cassette where conductive bars are located, for example seat portions 730, 732, 762 and 764.

Figure 36:
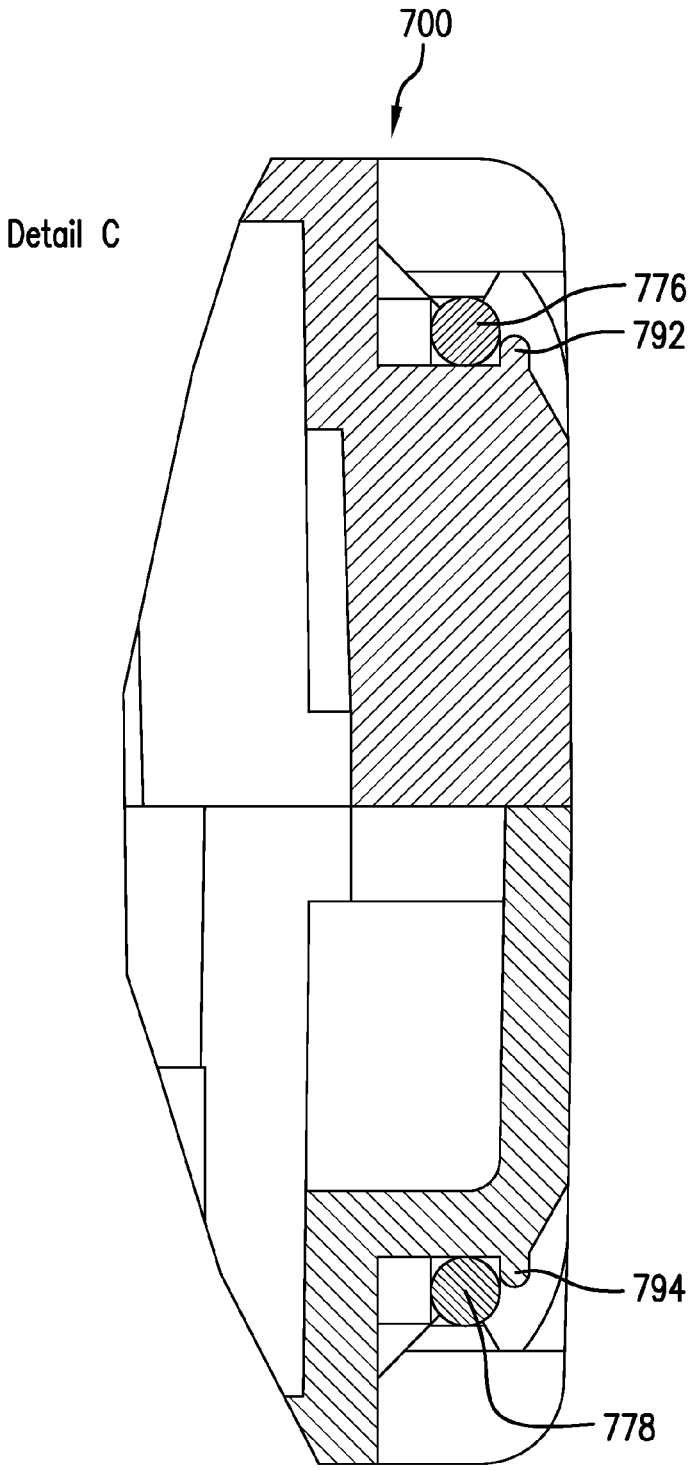
FIG. 36 is a detailed view of FIG. 33C.

FIG. 36 is a view of detail C from FIG. 33C. This figure is through section Y-Y, approximately midway along conductive bars 776 and 778. This figure clearly shows ribs 792 and 794.

Figure 37:
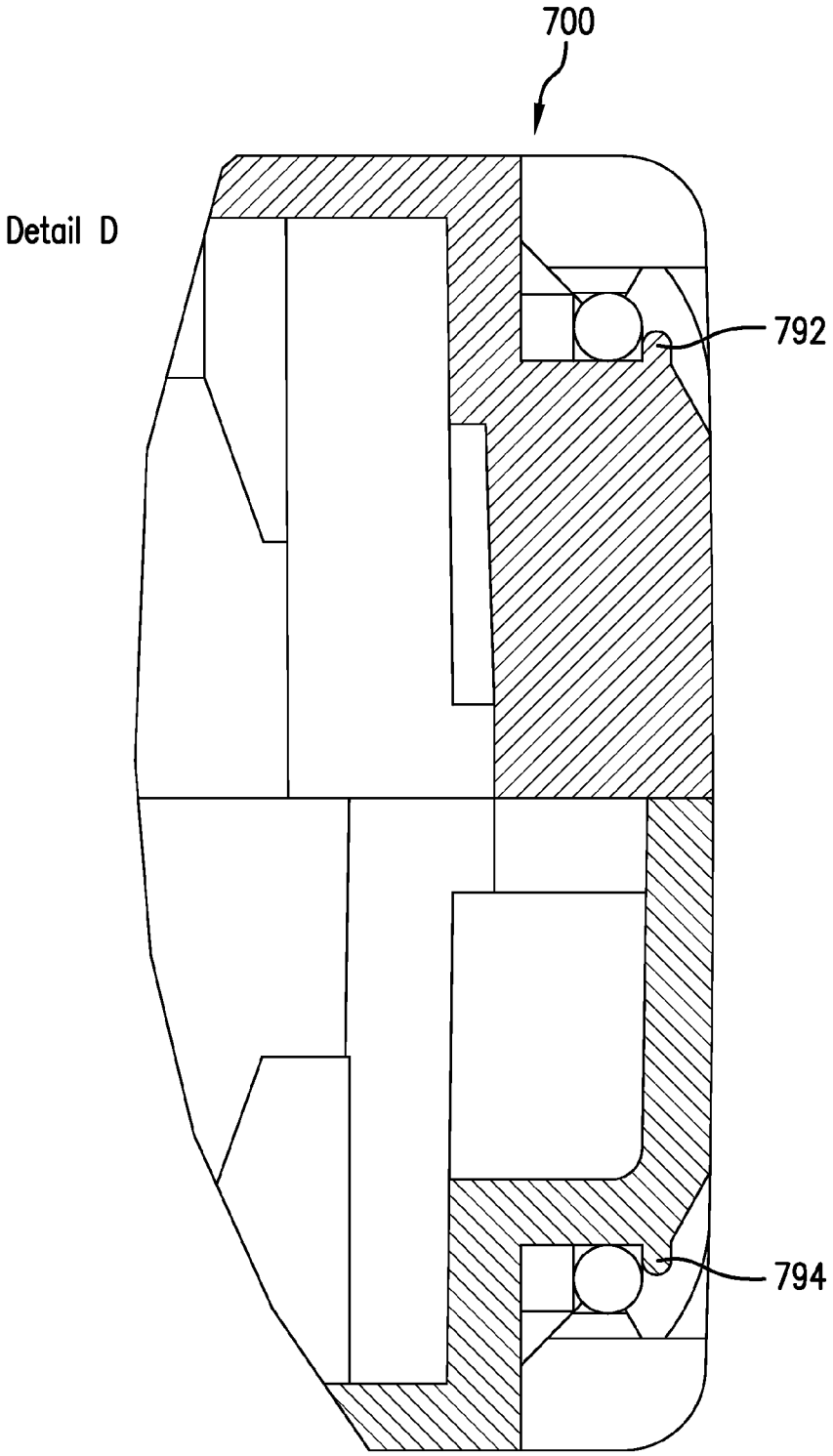
FIG. 37 is a detailed view of FIG. 33D.

FIG. 37 is also through section Y-Y, with the conductive bars 776 and 778 omitted. The ribs 792 and 794 are also visible in FIG. 37. These ribs act as per the rib 427' discussed in FIG. 21A, and the ribs 727 and 766 as described in relation to FIG. 32.

Locking elements for locking a cassette in a label printer have been discussed earlier, for example locking elements 26 and 32 shown in FIGS. 3, 5, 17, 22 and 23 etc.

FIGS. 27 to 29 show an alternative embodiment of a locking element. The locking element is shown generally at 626 in FIG. 27. The locking element 626 comprises conductive tracks 628 and 630 for engaging with a corresponding conductive member on a cassette. The locking element 626 also comprises a ramp portion 632 which protrudes upwardly from the locking portion. Either side of the ramped portion 632 are shoulder portions 642 and 644 upon which conductive tracks 628 and 630 are respectively mounted. The locking element 626 also comprises a main body portion 634 in the form of an upstanding post.

As will be appreciated from FIG. 28 the conductive track 628 extends from a front side of the locking element 626, along a ramped portion 629, across a top surface of the locking element over shoulder 642, and then down a rear side 637 of the locking element 626. The conductive track 628 can therefore be considered to extend from a first point 636 to a terminal 638 where it may connect with printer circuitry. The conductive track 628 also comprises a concavely curved portion 640 proximate to the first end 636. The concavely curved portion may assist with assembly. The conductive track 630 (not shown in FIG. 28) extends in the same manner as conductive track 628.

The reverse side 637 of the locking element 626, and in particular the reverse side of the conductive tracks 628 and 630 is best seen in FIG. 29. Also clearly visible in FIG. 29 is connection portion 645 of locking element 626. Connection portion 645 slots into a corresponding aperture in a label printing apparatus so that the locking element 626 can be retained therein.

Also shown in FIG. 29 are projections 650 and 652 which project through holes in the conductive track. The projections 650 and 652 are for assembling the conductive tracks on the body portion by a heat stake process. During the heat stake process the heat stake projections 650 and 652 are melted.

Figure 30:
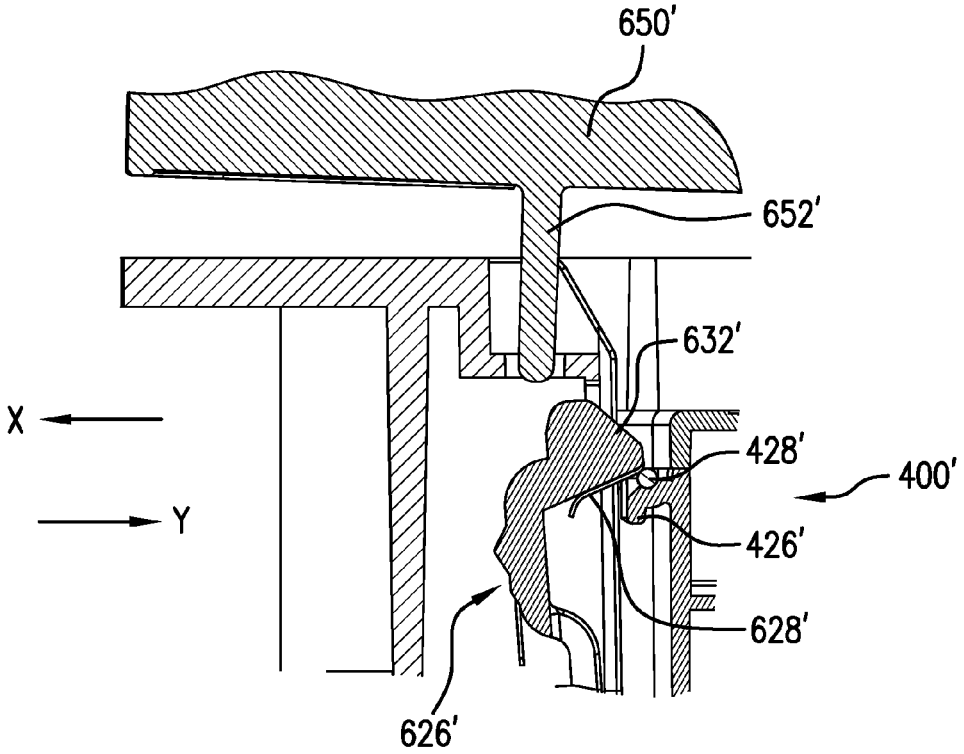
FIG. 30 is a sectional view showing a locking element of a label printing apparatus engaging with a cassette.
Figure 31:
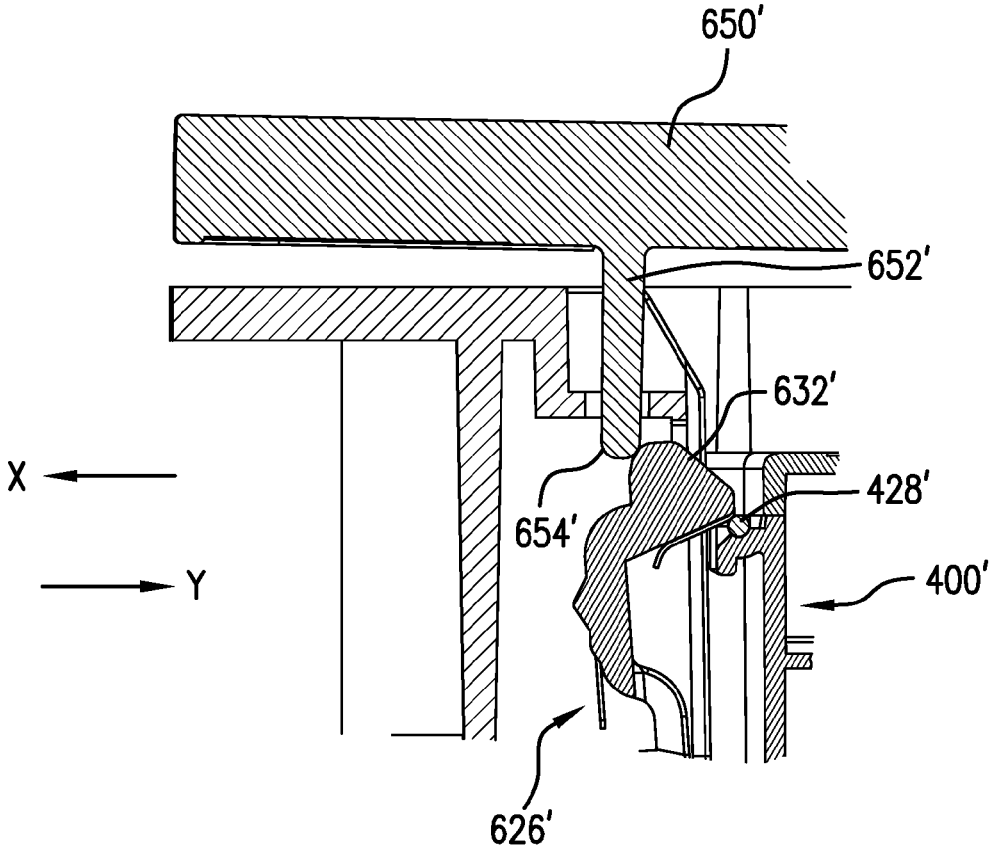
FIG. 31 is a sectional view showing a locking element of a label printing apparatus engaging with a cassette, when a lid of the label printing apparatus is closed.

FIGS. 30 and 31 show the interaction of a locking element 626' with a cassette 400' inserted therein. The cassette 400' comprises a conductive bar 428'. The locking element 626' comprises a conductive track 628' and 630' for interacting with conductive bar 428' of cassette 400', so as to detect when the cassette 400' is properly installed in the tape printing apparatus. The purpose of ramp portion 632' of locking element 626' can also be appreciated from this Figure. As the cassette 400' is inserted into the tape printing apparatus the ledge portion 426' acts on the ramp portion 632' of the locking element 626', thus forcing the locking element 626' to move in the direction of arrow X. After the cassette is inserted a certain distance and the ledge 426' and conductive bar 428' have moved under the most inwardly facing portion of locking element 626', then the locking element 626' springs back in the direction of arrow Y such that the conductive bar 428' (and consequently the cassette 400') is held in place by the locking element 626'. Also visible in FIGS. 30 and 31 is lid 650'. The lid 650' comprises a projection or "door pal" 652' which projects into the cassette receiving bay of the tape printing apparatus.

The function of the projection 652' is best appreciated by viewing FIG. 31. In this figure the cassette bay lid 650' is in the closed position and a bottom edge 654' of projection 652' has engaged with the top of locking element 626'. Accordingly movement of locking element 626' in the direction of arrow X is prohibited since it is blocked by projection 652'. This ensures that when the lid 650' is closed the locking element 626' remains engaged with the locking portion of the cassette. The cassette 400' is therefore securely held in the tape printing apparatus. This also ensures that the cassette is securely held in the event of the printer being dropped or subject to a large vibration.

Figure 38:
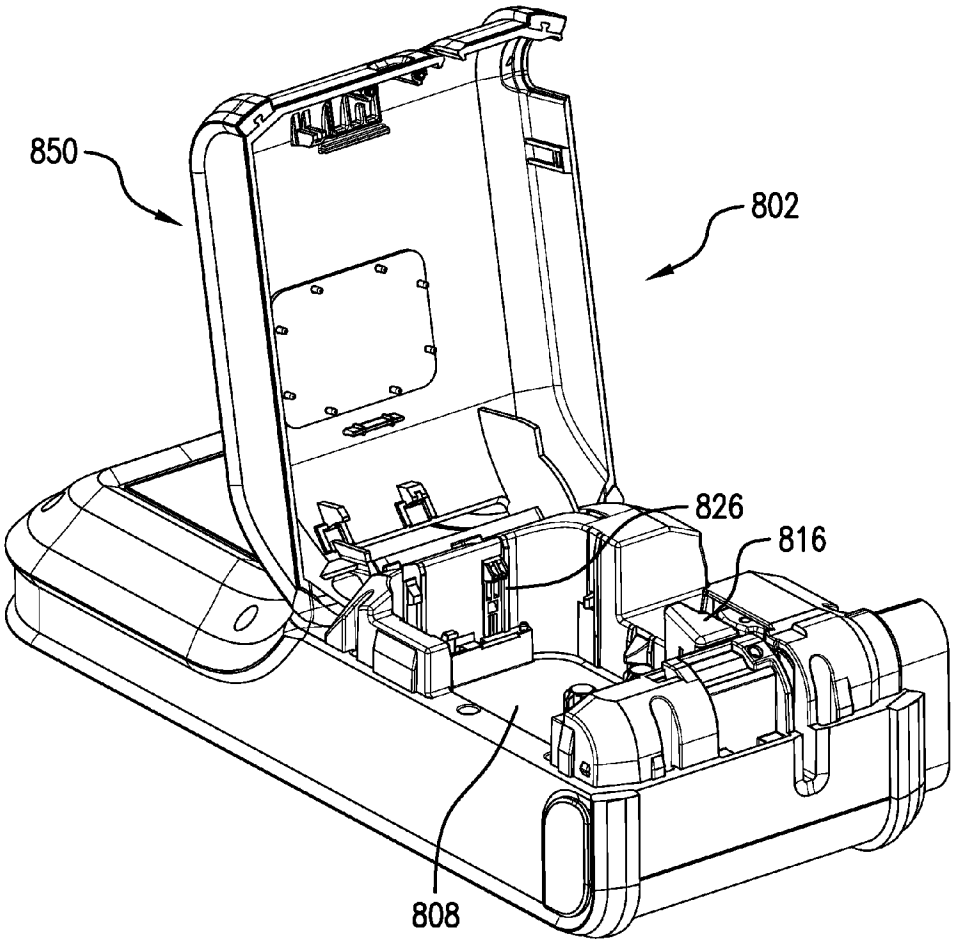
FIG. 38 is a perspective view of a label printer according to a further embodiment.

FIG. 38 shows a portable label printer 802 according to another embodiment. The label printer 802 comprises a cassette receiving bay 808 comprising a printhead 816. The label printer 802 also comprises a locking element 826. The locking element 826 is configured to operate in the same or a similar manner to the locking elements described with respect to FIGS. 22, 23 and 27 to 29. The label printer 802 also comprises a lid 850.

Figure 39:
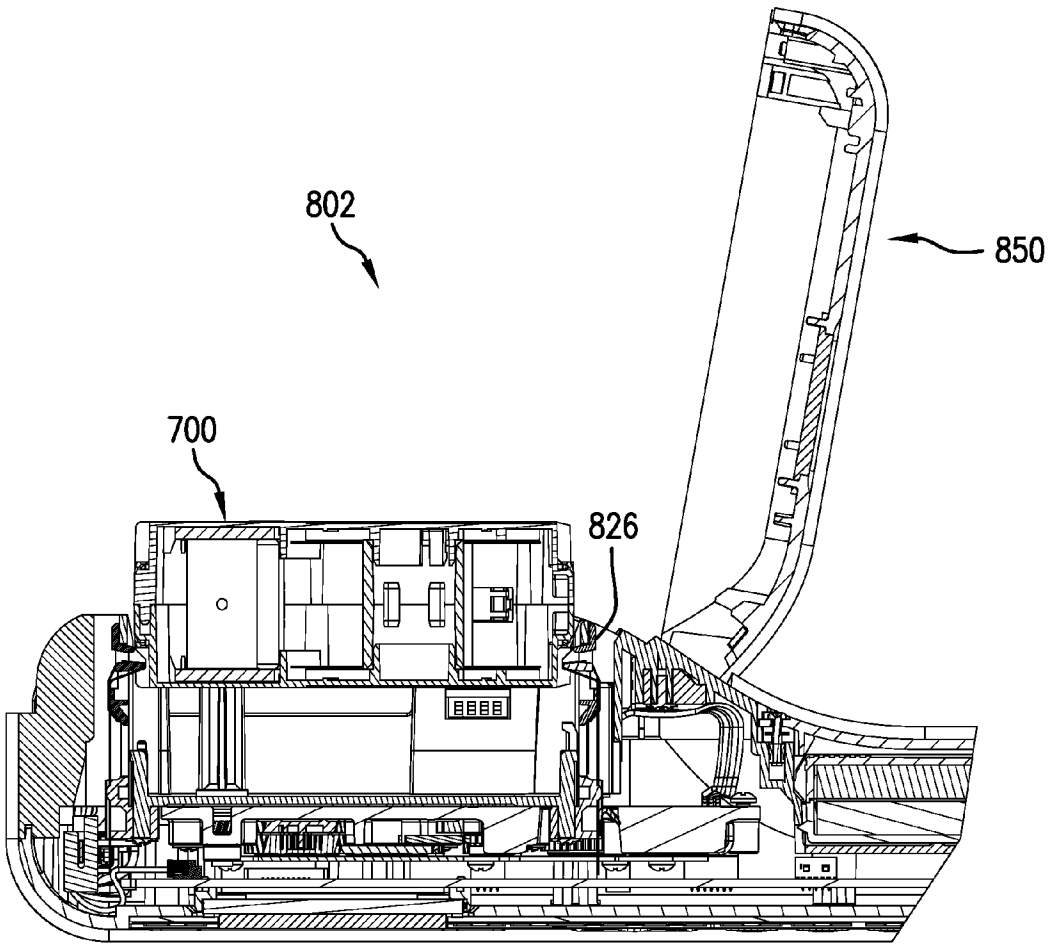
FIG. 39 is a sectional view of the label printer of FIG. 39, further including a cassette.

FIG. 39 is a sectional view through label printer 802. In this figure a cassette 700 of the type discussed with respect to FIGS. 32 to 37 is partially installed. The cassette is yet to make contact with the locking element 826, and therefore the locking element 826 is in its rest position i.e. partially protruding into the cassette receiving bay 808.

Figure 40:
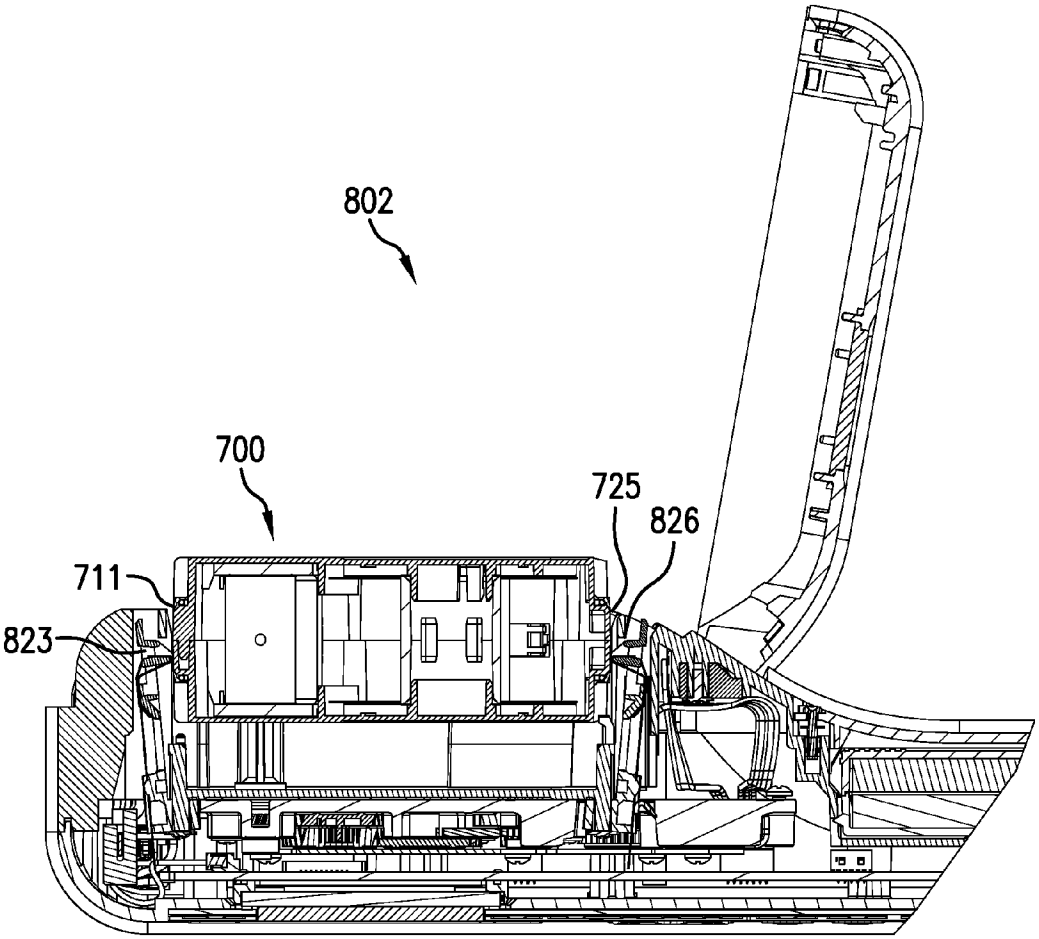
FIG. 40 shows the label printer of FIG. 39, with the cassette partially inserted.

In FIG. 40 the cassette has been further inserted. The locking portion 725 of the cassette is in contact with the locking element 826, which is accordingly pushed back in to the body of the label printer and out of the cassette receiving bay. This has also occurred on the opposite side of the cassette, where the locking portion 711 is in contact with locking element 832, thus pushing locking element 832 out of the cassette receiving bay and into the label printer body.

Figure 41:
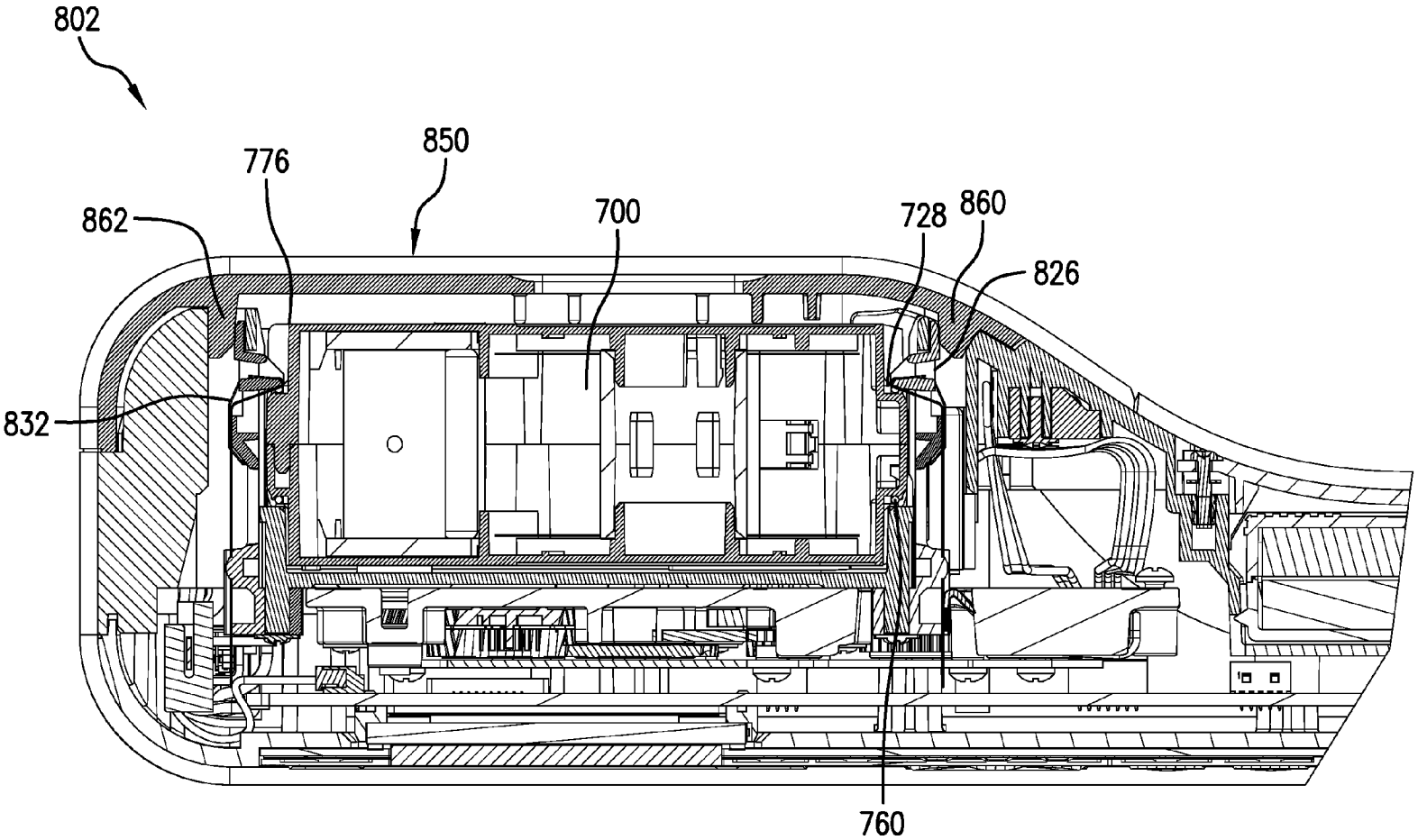
FIG. 41 shows the label printer of FIG. 39, with the cassette fully inserted.

FIG. 41 shows the cassette 700 fully inserted in label printer 802, and the lid 850 has been closed. In this figure the locking elements 826 and 832 have passed over the top of locking portions 725 and 711 of the cassette, and accordingly the locking elements 826 and 832 have sprung back towards their rest position, with a portion projecting into the cassette receiving bay 808. In a similar manner as described with respect to FIG. 22(*i*) and FIG. 31, the locking element 826 (and conductive portions thereof) are in contact with the conductive bar 728 of locking portion 725 such that the correct insertion of the cassette can be detected. Similarly the locking portion 832 can detect the insertion of the cassette by connecting to conductive bar 776 of locking portion 711. It can also be seen from FIG. 41 that the lid 850 comprises projections 860 and 862 which respectively engage locking elements 826 and 832, so as to secure the locking elements against the cassette locking portions when the cassette is fully inserted and the lid 850 is closed.

It should be appreciated that some embodiments may provide improved cassette locking and detection. By providing a conductive member for cassette detection on a locking portion of the cassette then correct cassette insertion and locking can be detected. Moreover the particular structure of the cassette locking portion, such as the conductive bar, in some embodiments not only acts as cassette detection means but the conductive member itself may also provide a locking function. For example a suitably designed locking element of a tape printing apparatus may "hook" itself over a corresponding conductive bar or other locking portion on the cassette such that the cassette can be securely held.

Some embodiments may also provide an improved method of manufacturing a cassette comprising a cassette detection feature. Turning back to FIG. 18 for example the conductive bar 428 can be attached to the cassette 400 as a step in the production of the cassette. The conductive bar 428 can be attached to the cassette 400 manually, or it may be affixed to the cassette as part of an automated process of cassette manufacture.

The conductive bar 428 can be affixed to the cassette 400 at any suitable stage in the cassette manufacturing procedure. For example it may be affixed before the base 402, top 404, and sides 406, 408, 410 and 412 are attached to each other. Alternatively the conductive bar 428 may be affixed to an otherwise completed cassette 400. The design of the receiving portions 430 and 432 which provide a push-fit for the conductive bar 428 facilitate the method of manufacture, since they enable the conductive bar 428 to be quickly and easily attached to the cassette 400. Any other type of friction fit is also possible between the conductive bar 428 and the seat or receiving portions 430 and 432, such as a snap-fit.

The conductive bar 428 can be affixed to the cassette by an automated process, for example using a robotic arm which is configured to insert the conductive bar 428 in to the receiving portions 430 and 432.

Figure 42:
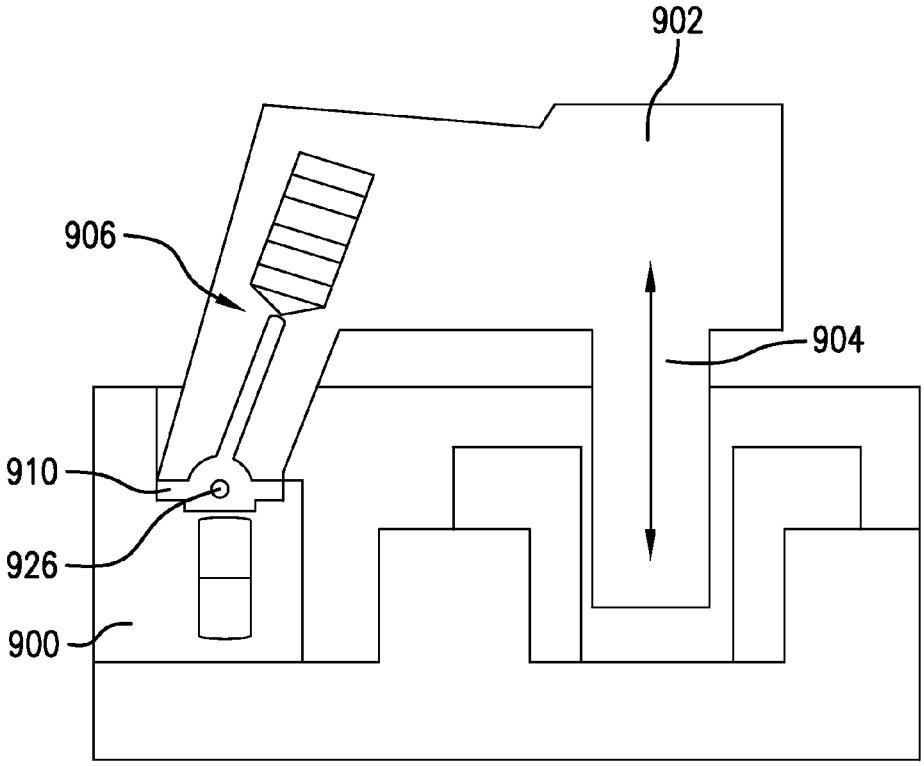
FIG. 42 is a schematic diagram of a machine for manufacturing embodiments of the cassette disclosed herein.

FIG. 42 is a schematic diagram demonstrating the insertion of a conductive bar 926 to a cassette 900. A machine 902 is configured for inserting the conductive bar in to the cassette 900. The machine 902 can move vertically as shown by arrow 904. The machine can also move in a direction into and out of the paper. In some embodiments the machine can also move in a direction from left to right with respect to FIG. 42. The machine 902 comprises an arm portion 906. The machine may hold a supply of conductive bars, for example in a hopper, or it may collect a conductive bar from a supply and then insert the conductive bar into the cassette 900. The machine 902 may hold the conductive bar 926 in any known way e.g. with suction, or using mechanical grippers, magnetic grippers, or the like. The machine 902 can insert the conductive bar 926 into the cassette by pushing it into the cassette e.g. by vertical movement in the direction of arrow 904, or it could push the conductive bar into the cassette in other ways e.g. with air pressure. It should be appreciated that the arm 906 of the machine is required to come into close proximity with the cassette in order to insert the conductive bar 926. Accordingly a space 910 is provided on the cassette, adjacent the receiving portion of the conductive bar, which gives the arm 906 room to move while inserting the conductive bar 926. This can also be appreciated from FIG. 35 for example, where the back wall 784 is shown spaced from the region where the conductive bar 776 is housed.

The foregoing merely illustrates the principles of certain embodiments. Modifications and alterations to the described embodiments will be apparent to those skilled in the art in view of the teaching herein. It will thus be appreciated that those skilled in the art would be able to devise numerous techniques which although not explicitly described herein, embody the principles of the described embodiments and are thus within the scope defined by the claims.

The invention claimed is:

1. A cassette comprising:

a housing having a first surface , a second surface opposite the first surface, and at least one side surface extending between the first surface and the second surface; and at least one locking portion located on the at least one side surface, the locking portion configured to engage with a cooperating locking element of a tape printer when said cassette is correctly located in said printer, said locking portion comprising a first elongate conductive bar having a longitudinal axis extending along said cassette in a direction perpendicular to a rotational axis of a supply roll housed in said cassette, and a second elongate conductive bar having a longitudinal axis extending along said cassette in a direction perpendicular to the rotational axis of the supply roll housed in said cassette, wherein the locking portion is symmetrically disposed about a plane passing through a center of the cassette, the central plane being parallel to the first and second surfaces, the first elongate conductive bar being positioned on the locking portion at a position between the central plane and the first surface, and the second elongate conductive bar being positioned on the locking portion at a position between the central plane and the second surface, the first elongate conductive bar being symmetrically disposed on the locking portion relative to the second elongate conductive bar.

2. A cassette as set forth in claim 1, wherein at least a portion of said elongate conductive bars projects from a surface of said cassette.

3. A cassette as set forth in claim 1, further comprising first and second ribs respectively positioned proximate to said first and second conductive bars.

4. A cassette as set forth in claim 3, wherein said first and second ribs each have a longitudinal axis which extends in a direction parallel to a longitudinal axis of their respective first and second conductive bars.

5. A cassette as set forth in claim 3, wherein said first and second conductive bars are each received in at least one respective support at at least one region along their respective lengths, wherein said first and second conductive bars are friction fits in their respective supports and the friction fit is between the support and its respective rib.

6. A cassette as set forth in claim 1, wherein the cassette comprises a recess in the at least one side, wherein the locking portion is located in the recess.

7. A cassette as set forth in claim 1, wherein said first and second bars each comprise a metal.

8. A cassette as set forth in claim 1, wherein said first and second bars are circular in cross section.

9. A cassette as set forth in claim 1, wherein said first and second conductive bars are received in at least one respective support at least one region along their respective lengths.

10. A cassette as set forth in claim 9, wherein said conductive bars are supported approximately mid-way along their lengths by said respective supports.

11. A cassette as set forth in claim 9, wherein said respective supports comprise first and second receiving portions for supporting opposite ends of said respective conductive bar.

12. A cassette as set forth in claim 11, wherein a section of said conductive bars, between said first and second receiving portions, are respectively spaced from a surface of said cassette.

13. A cassette as set forth in claim 9, wherein said first and second conductive bars are friction fits in their respective supports.

14. A cassette as set forth in claim 13, wherein said friction fit comprises one of a push-fit and a snap fit.

* * * * *